US011965232B2

(12) United States Patent
Kanki et al.

(10) Patent No.: US 11,965,232 B2
(45) Date of Patent: Apr. 23, 2024

(54) MARTENSITIC STAINLESS SEAMLESS STEEL PIPE

(71) Applicant: NIPPON STEEL CORPORATION, Tokyo (JP)

(72) Inventors: Kyohei Kanki, Tokyo (JP); Masayuki Sagara, Tokyo (JP); Yusaku Tomio, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 575 days.

(21) Appl. No.: 17/278,742

(22) PCT Filed: Oct. 1, 2019

(86) PCT No.: PCT/JP2019/038696
§ 371 (c)(1),
(2) Date: Mar. 23, 2021

(87) PCT Pub. No.: WO2020/071348
PCT Pub. Date: Apr. 9, 2020

(65) Prior Publication Data

US 2022/0033943 A1 Feb. 3, 2022

(30) Foreign Application Priority Data

Oct. 2, 2018 (JP) ..... 2018-187777

(51) Int. Cl.
*C22C 38/52* (2006.01)
*C21D 6/00* (2006.01)
(Continued)

(52) U.S. Cl.
CPC ..... *C22C 38/52* (2013.01); *C21D 6/004* (2013.01); *C21D 6/005* (2013.01); *C21D 6/007* (2013.01); *C21D 6/008* (2013.01); *C21D 8/105* (2013.01); *C21D 9/085* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01); *C22C 38/46* (2013.01);
(Continued)

(58) Field of Classification Search
None
See application file for complete search history.

(56) References Cited

U.S. PATENT DOCUMENTS 5,820,699 A 10/1998 Asahi et al.
2019/0136337 A1 5/2019 Eguchi et al.

FOREIGN PATENT DOCUMENTS

JP 08246107 A 9/1996
JP 101755 A 1/1998
(Continued)

*Primary Examiner* — Anthony M Liang
(74) *Attorney, Agent, or Firm* — Greer Burns & Crain Ltd.

(57) ABSTRACT

The seamless steel pipe according to the present disclosure includes a chemical composition consisting of, in mass %, C: 0.030% or less, Si: 1.00% or less, Mn: 1.00% or less, P: 0.030% or less, S: 0.0050% or less, Al: 0.001 to 0.100%, N: 0.0500% or less, O: 0.050% or less, Ni: 3.00 to 6.50%, Cr: more than 10.00 to 13.40%, Mo: 0.50 to 4.00%, V: 0.01 to 1.00%, Ti: 0.010 to 0.300%, and Co: 0.010 to 0.300%, with the balance being Fe and impurities, and satisfying Formula (1), and a microstructure containing, in volume ratio, 80.0% or more of martensite, wherein a depassivation pH of an inner surface is 3.50 or less.

$$Cr+2.0Mo+0.5Ni+0.5Co \geq 16.0 \quad (1)$$

8 Claims, 6 Drawing Sheets

(51) Int. Cl.

| | |
|---|---|
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/50*** | (2006.01) |

(52) U.S. Cl.
CPC ..... *C22C 38/50* (2013.01); *C21D 2211/008* (2013.01)

(56) References Cited

FOREIGN PATENT DOCUMENTS

| | | | |
|---|---|---|---|
| JP | 10503809 | A | 4/1998 |
| JP | 2000192196 | A | 7/2000 |
| JP | 2012136742 | A | 7/2012 |
| WO | 2017168874 | A1 | 10/2017 |

MARTENSITIC STAINLESS SEAMLESS STEEL PIPE

This is a National Phase Application filed under 35 U.S.C. § 371, of International Application No. PCT/JP2019/038696, filed Oct. 1, 2019, the contents of which are incorporated by reference.

TECHNICAL FIELD

The present disclosure relates to a seamless steel pipe, and more particularly to a martensitic stainless seamless steel pipe having a microstructure mainly composed of martensite.

BACKGROUND ART

Oil wells and gas wells (hereinafter, oil wells and gas wells are generally referred to as "oil wells") include an environment which contains large amounts of corrosive substances. Examples of corrosive substance include corrosive gases such as hydrogen sulfide and carbon dioxide gas. In the present description, an environment containing hydrogen sulfide and carbon dioxide gas is called as a "sour environment". The temperature of a sour environment is, though it depends on the depth of a well, in a range from a normal temperature to about 200° C. The term "normal temperature" as used herein means 24±3° C. in this description.

It is known that chromium (Cr) is effective for improving the carbon-dioxide gas corrosion resistance of steel. Therefore, in an oil well in an environment containing a large amount of carbon dioxide gas, martensitic stainless seamless steel pipe containing about 13 mass % of Cr, typified by API L80 13Cr steel material (normal 13Cr steel material) and Super 13Cr steel material in which C content is reduced, are used. The 13Cr steel material and the Super 13Cr steel material are used mainly in an oil well in a mild sour environment in which $H_2S$ partial pressure is 0.03 bar or less.

Meanwhile, of sour environments, an environment in which $H_2S$ partial pressure is more than 0.03 bar and 0.1 bar or less is called as an enhanced mild sour environment. In the enhanced mild sour environment, a duplex stainless seamless steel pipe in which the Cr content is higher than in the 13Cr steel material and in the Super 13Cr steel material is applied because the $H_2S$ partial pressure is higher than in the mild sour environment. However, the duplex stainless seamless steel pipe is more expensive than the 13Cr steel material and the Super 13Cr steel material. For that reason, there is a need for a steel material for oil wells which is usable in an enhanced mild sour environment even if the Cr content thereof is lower than that of a duplex stainless seamless steel pipe.

Japanese Patent Application Publication No. 10-1755 (Patent Literature 1), National Publication of International Patent Application No. 10-503809 (Patent Literature 2), Japanese Patent Application Publication No. 2000-192196 (Patent Literature 3), Japanese Patent Application Publication No. 08-246107 (Patent Literature 4), and Japanese Patent Application Publication No. 2012-136742 (Patent Literature 5) each propose a steel material excellent in SSC resistance.

The martensitic stainless steel according to Patent Literature 1 consists of, in mass %, C:0.005 to 0.05%, Si: 0.05 to 0.5%, Mn: 0.1 to 1.0%, P: 0.025% or less, S: 0.015% or less, Cr: 10 to 15%, Ni: 4.0 to 9.0%, Cu: 0.5 to 3%, Mo: 1.0 to 3%, Al: 0.005 to 0.2%, and N: 0.005% to 0.1%, with the balance being Fe and unavoidable impurities. The martensitic stainless steel has a chemical composition satisfying 40C+34N+Ni+0.3Cu−1.1Cr−1.8Mo≥−10. A microstructure of the martensitic stainless seamless steel pipe disclosed in this literature consists of a tempered martensite phase, a martensite phase, and a retained austenite phase, and a total fraction of the tempered martensite phase and the martensite phase is 60% or more to 80% or less, and the remainder is the retained austenite phase.

The martensitic stainless steel according to Patent Literature 2 consists of, in weight %, C: 0.005 to 0.05%, Si S 0.50%, Mn: 0.1 to 1.0%, P S 0.03%, S 0.005%, Mo: 1.0 to 3.0%, Cu: 1.0 to 4.0%, Ni: 5 to 8%, and Al≤0.06%, with the balance being Fe and impurities, and further satisfies Cr+1.6Mo≥13 and 40C+34N+Ni+0.3Cu−1.1Cr−1.81Mo≥−10.5. The microstructure of the martensitic stainless steel of this literature is a tempered martensite structure.

The martensitic stainless steel according to Patent Literature 3 consists of, in weight %, C: 0.001 to 0.05%, Si: 0.05 to 1%, Mn: 0.05 to 2%, P: 0.025% or less, S: 0.01% or less, Cr: 9 to 14%, Mo: 3.1 to 7%, Ni: 1 to 8%, Co: 0.5 to 7%, sol.Al: 0.001 to 0.1%, N: 0.05% or less, O (oxygen): 0.01% or less, Cu: 0 to 5%, and W: 0 to 5%, with the balance being Fe and unavoidable impurities.

The chemical composition of the martensitic stainless steel according to Patent Literature 4 consists of, in weight %, C: 0.005% to 0.05%, Si: 0.05% to 0.5%, Mn: 0.1% to 1.0%, P: 0.025% or less, S: 0.015% or less, Cr: 12 to 15%, Ni: 4.5% to 9.0%, Cu: 1% to 3%, Mo: 2% to 3%, W: 0.1% to 3%, Al: 0.005 to 0.2%, and N: 0.005% to 0.1%, with the balance being Fe and unavoidable impurities. The above described chemical composition further satisfies 40C+34N+Ni+0.3Cu+Co−1.1Cr−1.8Mo−0.9W≥−10.

The martensitic stainless seamless steel pipe according to Patent Literature 5 consists of, in mass %, C: 0.01% or less, Si: 0.5% or less, Mn: 0.1 to 2.0%, P: 0.03% or less, S: 0.005% or less, Cr: 14.0 to 15.5%, Ni: 5.5 to 7.0%, Mo: 2.0 to 3.5%, Cu: 0.3 to 3.5%, V: 0.20% or less, Al: 0.05% or less, and N: 0.06% or less, with the balance being Fe and unavoidable impurities. The martensitic stainless seamless steel pipe according to this literature has a yield strength: 655 to 862 MPa and a yield ratio: 0.90 or more.

CITATION LIST

Patent Literature

Patent Literature 1: Japanese Patent Application Publication No. 10-1755

Patent Literature 2: National Publication of International Patent Application No. 10-503809

Patent Literature 3: Japanese Patent Application Publication No. 2000-192196

Patent Literature 4: Japanese Patent Application Publication No. 08-246107

Patent Literature 5: Japanese Patent Application Publication No. 2012-136742

SUMMARY OF INVENTION

Technical Problem

In every one of the above described Patent Literatures 1 to 5, attention is paid to SSC resistance in an enhanced mild sour environment having an $H_2S$ partial pressure of more than 0.03 to 0.1 bar. Meanwhile, in the enhanced mild sour environment having an $H_2S$ partial pressure of more than 0.03 to 0.1 bar, active dissolution is advanced, and thus general corrosion is likely to occur. Further, an inner surface of a seamless steel pipe comes into direct contact with production fluid, and thus particularly general corrosion is likely to occur. Therefore, excellent general corrosion resistance is needed for an inner surface of a seamless steel pipe used in an enhanced mild sour environment having an $H_2S$ partial pressure of more than 0.03 to 0.1 bar. However, Patent Literatures 1 to 5 have no studies on general corrosion resistance of an inner surface of a seamless steel pipe in an enhanced mild sour environment having an $H_2S$ partial pressure of more than 0.03 to 0.1 bar.

An objective of the present disclosure is to provide a martensitic stainless seamless steel pipe including an inner surface having excellent general corrosion resistance even in an enhanced mild sour environment having an $H_2S$ partial pressure of more than 0.03 to 0.1 bar.

Solution to Problem

A martensitic stainless seamless steel pipe according to the present disclosure includes a chemical composition consisting of, in mass %, C: 0.030% or less, Si: 1.00% or less, Mn: 1.00% or less, P: 0.030% or less, S: 0.0050% or less, Al: 0.001 to 0.100%, N: 0.0500% or less, O: 0.050% or less, Ni: 3.00 to 6.50%, Cr: more than 10.00 to 13.40%, Mo: 0.50 to 4.00%, V: 0.01 to 1.00%, Ti: 0.010 to 0.300%, Co: 0.010 to 0.300%, Ca: 0 to 0.0035%, and W: 0 to 1.50%, with the balance being Fe and impurities, and satisfying Formula (1), and a microstructure containing, in volume ratio, 80.0% or more of martensite, wherein a depassivation pH of an inner surface of the martensitic stainless seamless steel pipe is 3.50 or less in an aqueous solution that contains 5 mass % of NaCl and 0.41 g/L of $CH_3COONa$ and further contains $CH_3COOH$:

$$Cr+2.0Mo+0.5Ni+0.5Co \geq 16.0 \quad (1)$$

where, a content of a corresponding element (in mass %) is substituted for each symbol of an element in Formula (1).

Advantageous Effects of Invention

The martensitic stainless seamless steel pipe according to the present disclosure includes an inner surface having excellent general corrosion resistance even in an enhanced mild sour environment having an $H_2S$ partial pressure of more than 0.03 to 0.1 bar.

DESCRIPTION OF EMBODIMENTS

Figure 1:
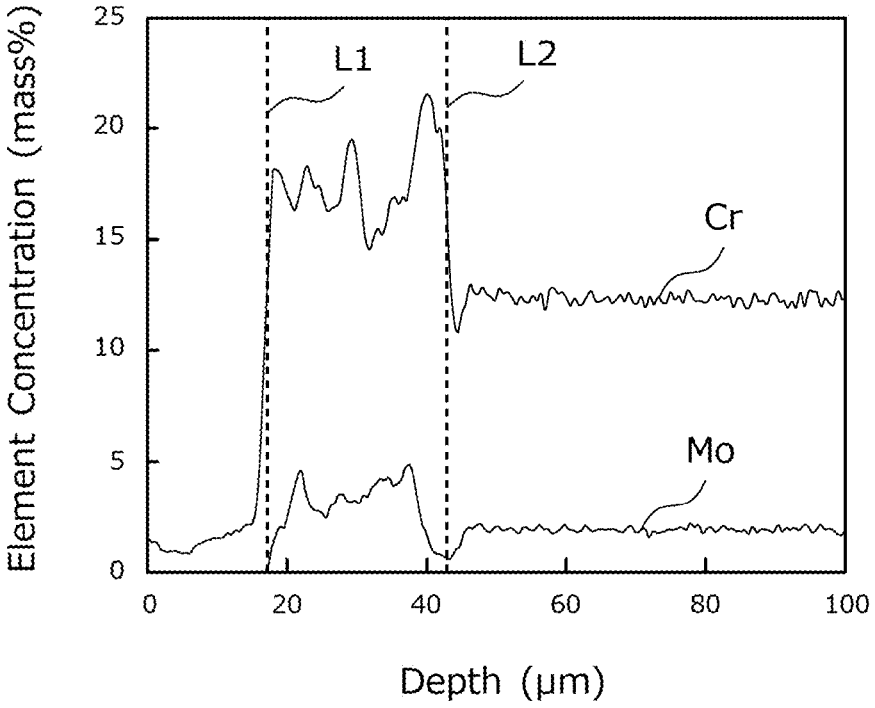
FIG. 1 is a schematic diagram of a result of cross-sectional profile measurement of Cr and Mo concentrations in a vicinity of an inner surface of a seamless steel pipe in EPMA.

The present inventors conducted study on a martensitic stainless seamless steel pipe that includes an inner surface having excellent general corrosion resistance by suppressing active dissolution even in an enhanced mild sour environment having an $H_2S$ partial pressure of more than 0.03 to 0.1 bar. As a result of the study, the present inventors came to consider that excellent general corrosion resistance can be achieved, even in an enhanced mild sour environment, with a martensitic stainless seamless steel pipe according to the present disclosure that includes a chemical composition consisting of, in mass %, C: 0.030% or less, Si: 1.00% or less, Mn: 1.00% or less, P: 0.030% or less, S: 0.0050% or less, Al: 0.001 to 0.100%, N: 0.0500% or less, O: 0.050% or less, Ni: 3.00 to 6.50%, Cr: more than 10.00 to 13.40%, Mo: 0.50 to 4.00%, V: 0.01 to 1.00%, Ti: 0.010 to 0.300%, Co: 0.010 to 0.300%, Ca: 0 to 0.0035%, and W: 0 to 1.50%, with the balance being Fe and impurities, and has a microstructure mainly composed of martensite.

The present inventors conducted investigation and study on how to increase general corrosion resistance of an inner surface of a seamless steel pipe. First, the present inventors paid attention to depassivation pH as an index of general corrosion resistance of a seamless steel pipe. In the present description, the depassivation pH means a lowest pH down to which a steel material can maintain a passive state in a specific environment. The passive state means a state in which a passive film is formed over an entire surface in a given region of a steel material, suppressing general corrosion. That is, under an environment having a pH lower than the depassivation pH, a passive film on the surface of a steel material is partly or entirely broken, which causes active dissolution to proceed, thus causing general corrosion on the steel material. Therefore, the lower the depassivation pH, a passive film is maintained even in a sour environment having a low pH, increasing general corrosion resistance. In the present description, the depassivation pH is also denoted as "pHd".

Next, the present inventors conducted detailed investigation on elements that decrease a depassivation pH of a seamless steel pipe. Of elements included in the above described chemical composition, Cr, Mo, Ni, and Co are listed as elements that stabilize a passive film. Cr forms the passive film. Meanwhile, as described above, Mo, Ni, and Co form sulfides to suppress the passive film from being broken. Specifically, in an enhanced mild sour environment, since an $H_2S$ partial pressure is as high as more than 0.03 to 0.1 bar, a passive film is likely to be broken by hydrogen sulfide ions ($HS^-$) and chloride ions ($Cl^-$) in the environment. However, in the seamless steel pipe having the above described chemical composition and the above described microstructure, the Mo sulfide, Ni sulfide, and Co sulfide are formed on its passive film, which can suppress hydrogen sulfide ions and chloride ions from coming into direct contact with the passive film. As a result, breakage of the passive film by the hydrogen sulfide ions and the chlorine ions can be suppressed.

Then, the present inventors conducted detailed investigation and study on the relation between depassivation pH and Cr, Mo, Ni, and Co contents in a seamless steel pipe having the above described chemical composition and microstructure. As a result, the present inventors have found that, for a seamless steel pipe having the above described chemical composition and microstructure, it is possible to further increase general corrosion resistance in a stable manner in an enhanced mild sour environment having an $H_2S$ partial pressure of more than 0.03 to 0.1 bar by satisfying the following Formula (1):

$$Cr+2.0Mo+0.5Ni+0.5Co \geq 16.0 \quad (1)$$

where, a content of a corresponding element (in mass %) is substituted for each symbol of an element in Formula (1).

F1 is defined as F1=Cr+2.0Mo+0.5Ni+0.5Co. F1 is an index relating to stability of a passive film. The higher F1 is, the more the passive film is stabilized. If F1 is less than 16.0, the passive film becomes unstable, and the depassivation pH becomes more than 3.50. As a result, general corrosion resistance of a steel material decreases. Therefore, the martensitic stainless seamless steel pipe according to the present embodiment has the above described chemical composition and microstructure, and further has F1 being 16.0 or more.

However, there was a case in which excellent general corrosion resistance of an inner surface could not be obtained even with the martensitic stainless seamless steel pipe having the above described chemical composition and microstructure and satisfying Formula (1). Then, the present inventors conducted detailed investigation and study on the relation between depassivation pH and a condition of a vicinity of an inner surface of the seamless steel pipe having the above described chemical composition and microstructure and satisfying Formula (1).

FIG. 1 is a schematic diagram of a result of cross-sectional profile measurement of Cr and Mo concentrations in a vicinity of an inner surface of a seamless steel pipe in EPMA. FIG. 1 was obtained by the following method. Elemental analysis was performed by EPMA on a seamless steel pipe that has a chemical composition containing, in mass %, C: 0.030% or less, Si: 1.00% or less, Mn: 1.00% or less, P: 0.030% or less, S: 0.0050% or less, Al: 0.001 to 0.100%, N: 0.0500% or less, O: 0.050% or less, Ni: 3.00 to 6.50%, Cr: more than 10.00 to 13.40%, Mo: 0.50 to 4.00%, V: 0.01 to 1.00%, Ti: 0.010 to 0.300%, and Co: 0.010 to 0.300%, and has a microstructure mainly composed of martensite. Note that the seamless steel pipe illustrated in FIG. 1 was not subjected to blasting treatment and pickling treatment to be described below.

The ordinate of FIG. 1 indicates element concentration (mass %) that was obtained by the elemental analysis by EPMA. The abscissa of FIG. 1 indicates depth (μm) that was defined such that its origin is placed inward of an inner surface of the seamless steel pipe having the above described chemical composition and microstructure in a pipe diameter direction (i.e., a hollow region) and its positive direction is a direction in the pipe diameter direction going from the inner surface toward an outer surface.

As described above, the steel material illustrated in FIG. 1 was not subjected to blasting treatment and pickling treatment to be described below. Therefore, scales were formed on an outer layer of the steel material illustrated in FIG. 1. It has been considered that Cr is concentrated normally in scales. That is, referring to FIG. 1, scales are considered to lie between a line segment L1 and a line segment L2. Meanwhile, between the line segment L1 and the line segment L2 of FIG. 1, not only a Cr concentration but also a Mo concentration increases. That is, the result of the detailed investigation conducted by the present inventors clarified that not only Cr but also Mo was concentrated.

Further, referring to FIG. 1, a zone in which the Cr and Mo concentrations decrease can be found on the right of the line segment L2. That is, in a steel material on which scales are formed, the zone in which the Cr and Mo concentrations decrease (hereinafter, also called as "element-depleted layer") is formed in a region adjacent to scales. Here, Cr and Mo stabilize a passive film of a steel material. That is, the present inventors considered that the formation of an element-depleted layer makes a passive film of a steel material unstable, thus decreasing general corrosion resistance of the steel material.

Here, in a process of producing a seamless steel pipe to be used in oil wells in a mild sour environment or an enhanced mild sour environment, blasting treatment, typified by shot-blast, is normally performed in a final process in order to remove scales on an inner surface of a seamless steel pipe. Here, the blasting treatment is a treatment in which the surface of a steel material is ground mechanically. Further, as described above, in an outer layer of a steel material on which scales are formed, an element-depleted layer is formed in a region adjacent to the scales. However, in a case in which blasting treatment is performed on a steel material including an outer layer covered with scales, although the scales can be removed, there is a possibility that an element-depleted layer in the outer layer cannot be removed sufficiently. That is, there is concern that an element-depleted layer remains on an outer layer of an inner surface of a seamless steel pipe subjected to blasting treatment.

As described above, Cr and Mo stabilize a passive film of a steel material. That is, even when blasting treatment is performed, an element-depleted layer partly remaining on an outer layer of an inner surface of a seamless steel pipe makes a passive film unstable in a region where the element-depleted layer remains. As a result, there is a case in which excellent general corrosion resistance of an inner surface cannot be obtained even with a seamless steel pipe having a chemical composition satisfying Formula (1) and the above described microstructure.

Then, the present inventors came to consider that general corrosion resistance of an inner surface of a seamless steel pipe may be increased when scales and an element-depleted layer are removed from an outer layer by performing pickling treatment instead of blasting treatment. Specifically, the present inventors conceived performing two-stage pickling treatment, which will be described below in a preferable production method. Of the two-stage pickling treatment, in pickling treatment as a first stage, a steel material is immersed in an acid aqueous solution for a long time. As a result, an entire outer layer of the steel material is dissolved sufficiently. That is, it is possible to remove scales and an element-depleted layer from the outer layer of the steel material. Further, of the two-stage pickling treatment, in pickling treatment as a second stage, the outer layer of the steel material is activated. It is consequently possible to form a strong passive film on the outer layer of the steel material.

In this manner, it can be expected that performing the two-stage pickling treatment according to the preferable production method to be described below removes scales and an element-depleted layer from an outer layer of a steel material and further forms a strong passive film on the outer layer of the steel material. In this case, a depassivation pH of an inner surface of a seamless steel pipe should decrease, and general corrosion resistance of the inner surface of the seamless steel pipe should increase. Based on the above described result of study, the present inventors investigated the relation between depassivation pH and the presence or absence of performing blasting treatment and pickling treatment, for a steel material having the above described chemical composition and microstructure and satisfying Formula (1). Results of the investigation are shown in Table 1.

TABLE 1

| ID No. | Test No. | Steel | Blasting treatment | Pickling treatment | Posttreatment | pHd |
|---|---|---|---|---|---|---|
| A-1 | 24 | A | — | — | Not performed | 3.88 |
| A-2 | 19 | A | Performed | — | Only blasting treatment | 3.51 |
| A-3 | 22 | A | — | Performed | Only pickling treatment | 3.67 |
| A-4 | 1 | A | Performed | Performed | Blasting treatment + Pickling Treatment | 3.05 |
| B-1 | 25 | B | — | — | Only blasting treatment | 4.02 |
| B-2 | 20 | B | Performed | — | Only blasting treatment | 3.60 |
| B-3 | 23 | B | — | Performed | Only pickling treatment | 3.82 |
| B-4 | 2 | B | Performed | Performed | Blasting treatment + Pickling treatment | 3.21 |

Table 1 extracts and shows depassivation pH and whether the blasting treatment and the pickling treatment were performed, for steels A and B in EXAMPLE described below. Both of the steels A and B shown in Table 1 had the above described chemical composition and satisfied Formula (1). Every one of steel materials shown in Table 1 had a microstructure mainly composed of martensite.

The term "Performed" shown in the column "Blasting treatment" and the column "Pickling treatment" in Table 1 means that the respective treatments were performed by the preferable production method to be described below. The mark "-" in the column "Blasting treatment" and the column "Pickling treatment" in Table 1 means that the respective treatments were not performed. The column "Posttreatment" in Table 1 collectively shows operating status of the blasting treatment and the pickling treatment. The column "pHd" in Table 1 shows depassivation pH obtained by a method to be described below.

Figure 2A:
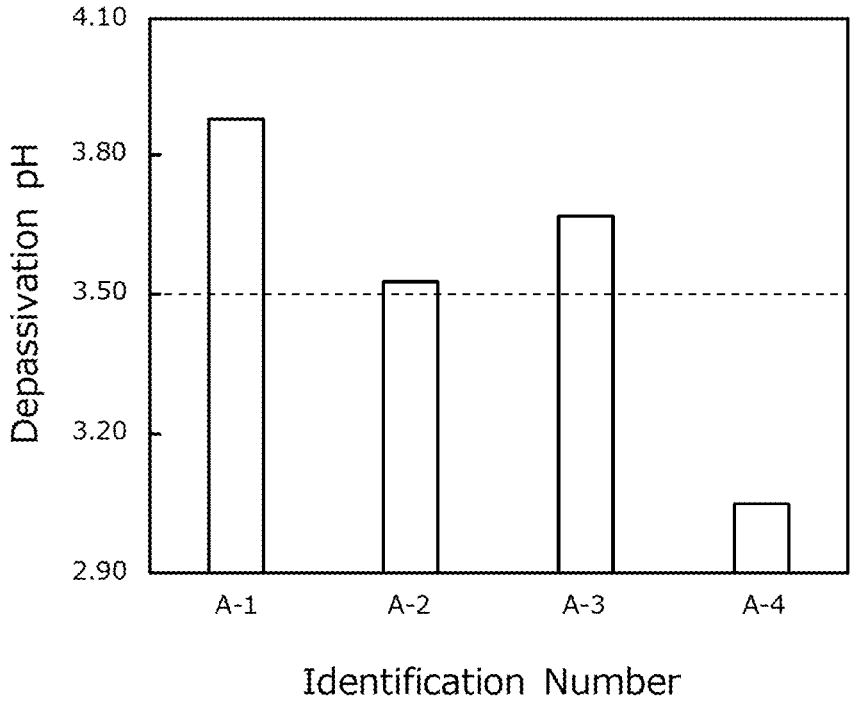
FIG. 2A is a graph illustrating a depassivation pH for each identification number of the steel A.
Figure 2B:
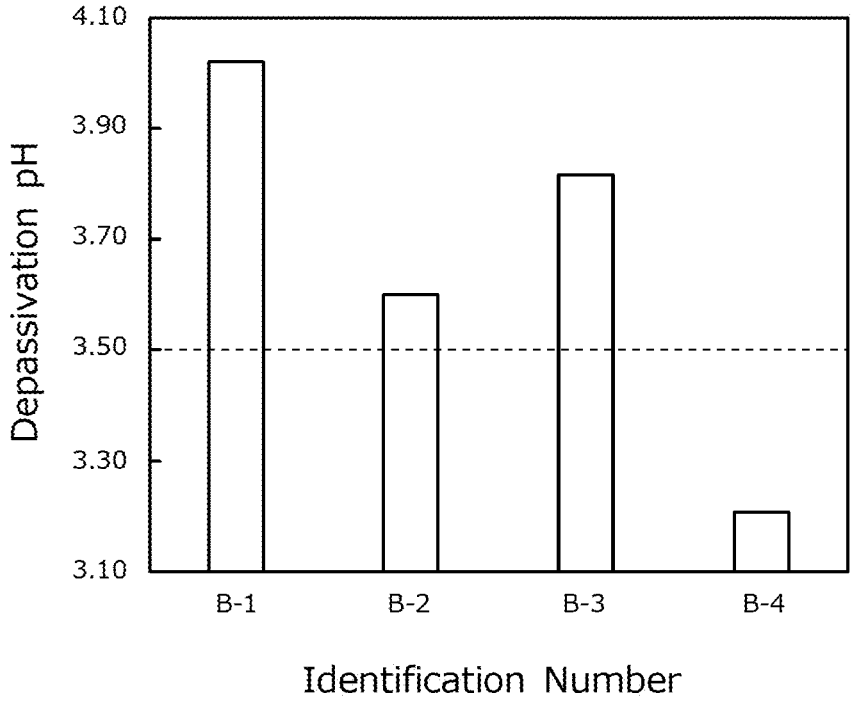
FIG. 2B is a graph illustrating a depassivation pH for each identification number of the steel B.

Further, results shown in Table 1 are illustrated in FIG. 2A and FIG. 2B. FIG. 2A is a graph illustrating a depassivation pH for each identification number of the steel A. FIG. 2B is a graph illustrating a depassivation pH for each identification number of the steel B.

Referring to Table 1, FIG. 2A, and FIG. 2B, steel materials subjected only to the blasting treatment (identification numbers A-2 and B-2) resulted in decrease in depassivation pHs, compared with steel materials not subjected to the posttreatment (identification numbers A-1 and B-1). That is, performing the blasting treatment increased general corrosion resistances of the steel materials. Further, referring to Table 1, FIG. 2A, and FIG. 2B, steel materials subjected only to the pickling treatment (identification numbers A-3 and B-3) resulted in increase in depassivation pHs, compared with the steel materials subjected only to the blasting treatment (the identification numbers A-2 and B-2). That is, performing the pickling treatment instead of the blasting treatment rather decreased general corrosion resistances of the steel materials.

Further, referring to Table 1, FIG. 2A, and FIG. 2B, steel materials subjected to the blasting treatment and the pickling treatment (identification numbers A-4 and B-4) resulted in significant decrease in depassivation pH, compared with the steel materials subjected only to the blasting treatment (the identification numbers A-2 and B-2) and the steel materials subjected only to the pickling treatment (the identification numbers A-3 and B-3). In particular, as is evident from FIG. 2A and FIG. 2B, when blasting treatment and pickling treatment are performed on a steel material having the above described chemical composition and the above described microstructure, and satisfying Formula (1), depassivation pH significantly decreases. That is, as a result of the detailed study by the present inventors, it has been newly found that when the blasting treatment and the pickling treatment are both performed, general corrosion resistance of a steel material significantly increases.

As described above, by the two-stage pickling treatment described in the preferable production method to be described below, it is possible that scales and an element-depleted layer can be both removed. However, performing only the pickling treatment on steel materials resulted in a failure to obtain excellent general corrosion resistance. The reason for this has not been clarified in detail. However, the present inventors consider the reason as follows. In the pickling treatment according to the present embodiment, an outer layer of a steel material is considered to be dissolved substantially evenly as a whole. That is, in a case in which an outer layer of a steel material is coarsened in a microscopic view because of the formation of scales, there is a possibility that the outer layer of the steel material maintains the coarsened state in a microscopic view if the steel material is subjected only to pickling treatment.

Figure 3A:
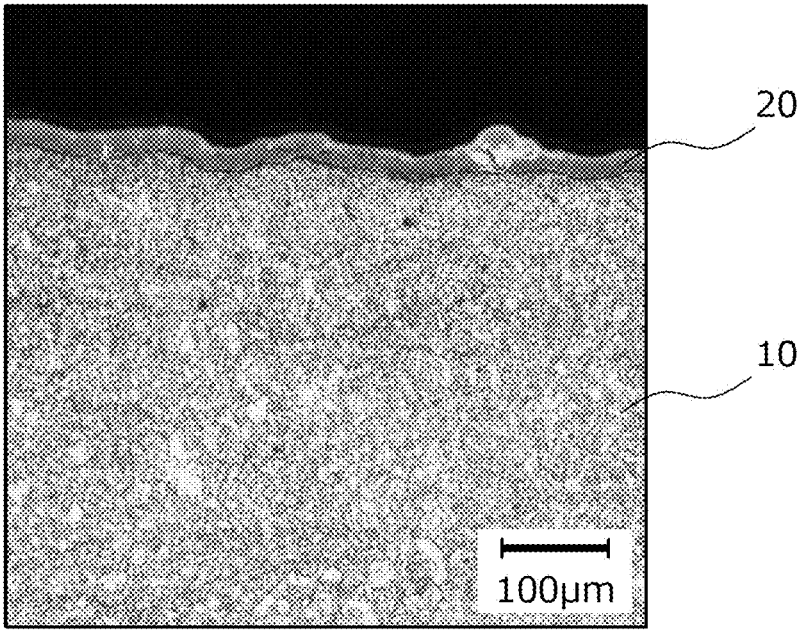
FIG. 3A is a sectional structure observation image of a vicinity of an inner surface of a seamless steel pipe subjected only to pickling treatment, under an optical microscope.
Figure 3B:
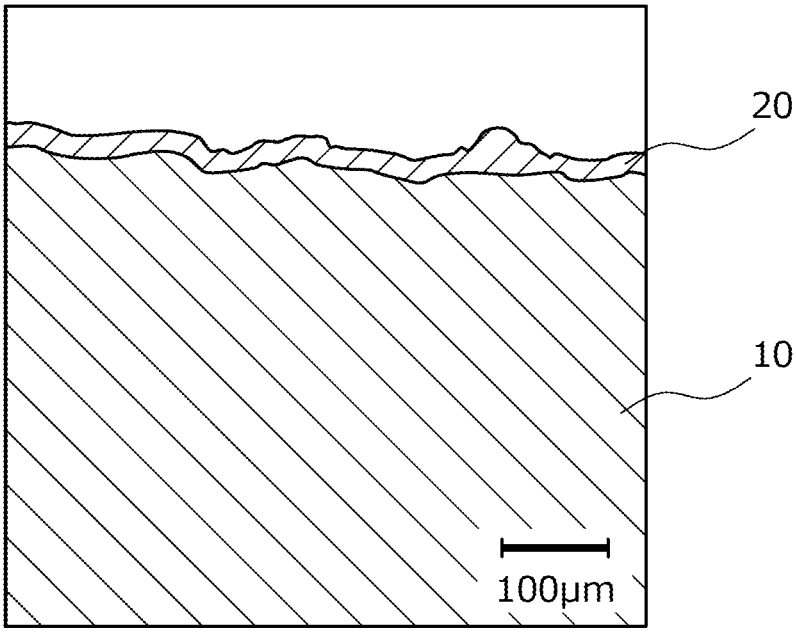
FIG. 3B is a schematic diagram of FIG. 3A.
Figure 4A:
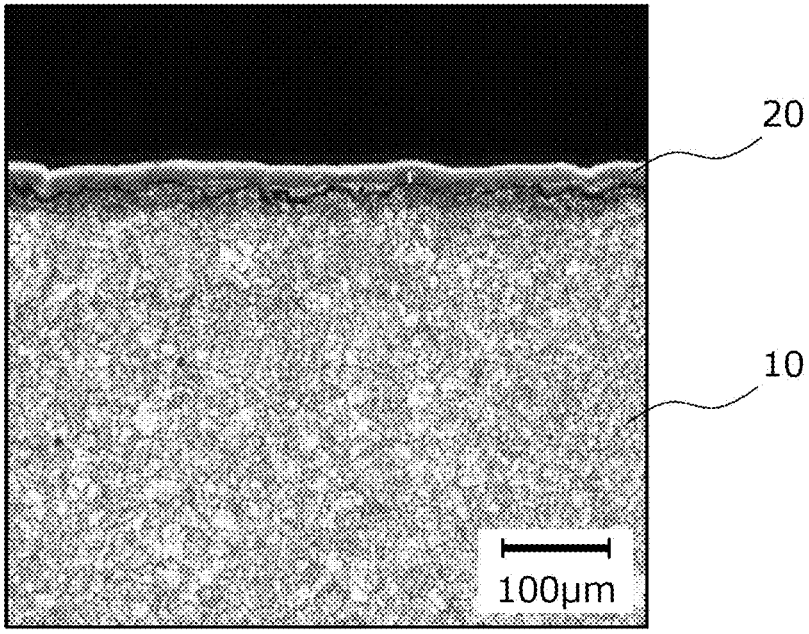
FIG. 4A is a sectional structure observation image of a vicinity of an inner surface of a seamless steel pipe subjected only to blasting treatment, under an optical microscope.
Figure 4B:
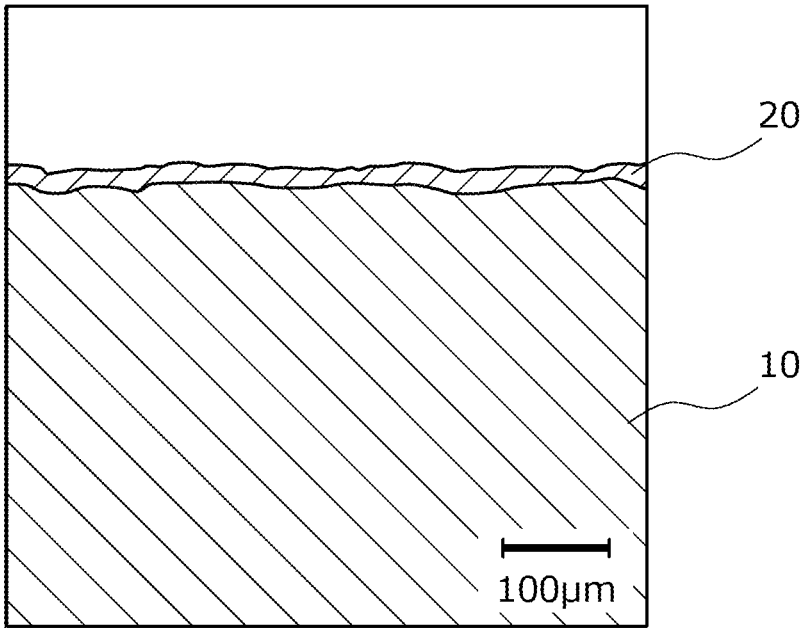
FIG. 4B is a schematic diagram of FIG. 4A.
Figure 5A:
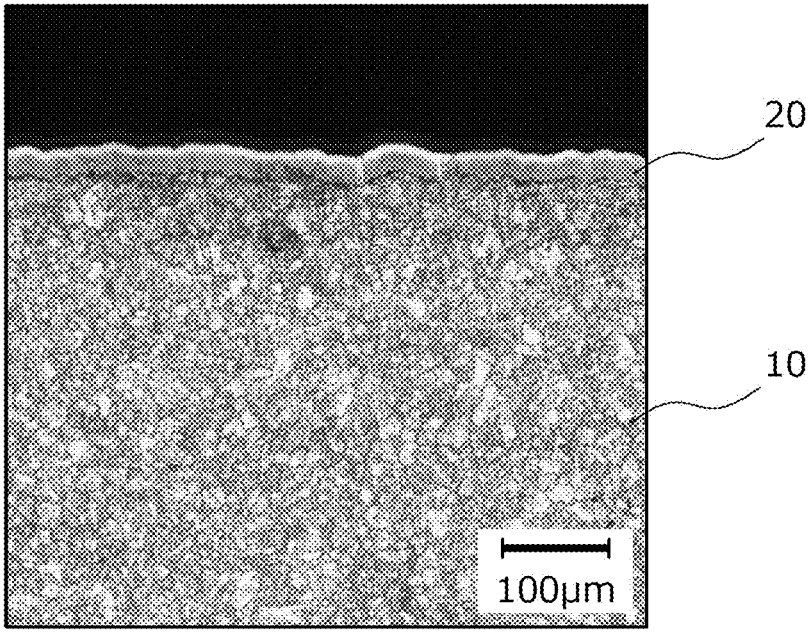
FIG. 5A is a sectional structure observation image of a vicinity of an inner surface of a seamless steel pipe subjected to blasting treatment and pickling treatment, under an optical microscope.
Figure 5B:
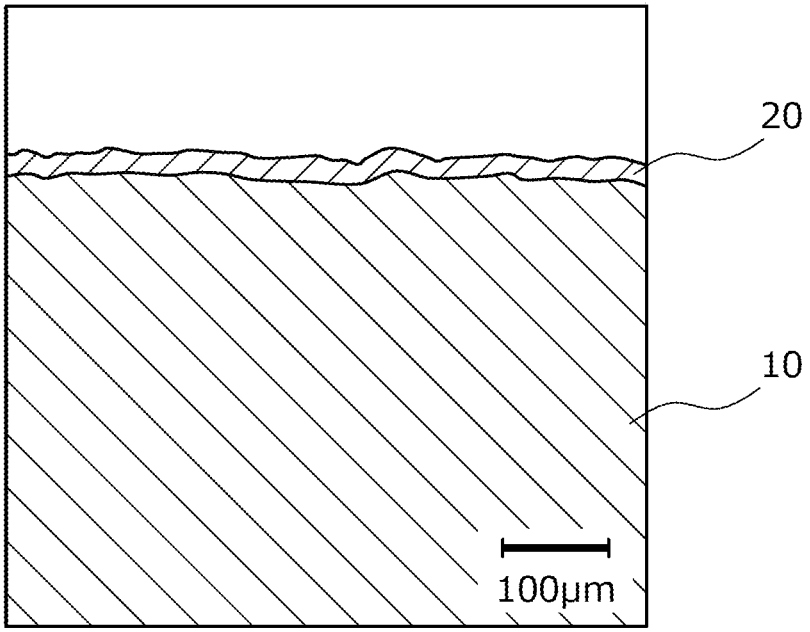
FIG. 5B is a schematic diagram of FIG. 5A.

This regard will be described with reference to drawings. FIG. 3A is a sectional structure observation image of a vicinity of an inner surface of a seamless steel pipe subjected only to pickling treatment, under an optical microscope. FIG. 3B is a schematic diagram of FIG. 3A. FIG. 4A is a sectional structure observation image of a vicinity of an inner surface of a seamless steel pipe subjected only to blasting treatment, under an optical microscope. FIG. 4B is a schematic diagram of FIG. 4A. FIG. 5A is a sectional structure observation image of a vicinity of an inner surface of a seamless steel pipe subjected to blasting treatment and pickling treatment, under an optical microscope. FIG. 5B is a schematic diagram of FIG. 5A.

FIG. 3A to FIG. 5B were obtained by the following method. In the present description, a pipe axis direction of a seamless steel pipe is defined as an "L direction". A pipe diameter direction of the seamless steel pipe is defined as a "T direction". A direction that is perpendicular to the L direction and the T direction (equivalent to a pipe circumferential direction) is defined as a "C direction". Test specimens each having an observation surface including the T direction and the C direction were taken from inner surfaces of a seamless steel pipe subjected only to pickling treatment, a seamless steel pipe subjected only to blasting treatment, and a seamless steel pipe subjected to the pickling treatment and the blasting treatment. That is, the observation surface of each test specimen is equivalent to a cross section that is perpendicular to the L direction of the seamless steel pipe.

An Ni-plating film was formed on a region of each of the test specimens equivalent to an inner surface of a seamless steel pipe. After the observation surface of the test specimen embedded in resin was mirror-polished, the test specimen was immersed in the Vilella's reagent (a mixed solution of ethanol, hydrochloric acid, and picric acid) for about 60 seconds and then etched, by which a grain-boundary tempered structure was exposed. FIG. 3A, FIG. 4A, and FIG. 5A are photographic images obtained by optical microscope observation performed on etched observation surfaces. An observation magnification of FIG. 3A, FIG. 4A, and FIG. 5A is 200 times. FIG. 3B, FIG. 4B, and FIG. 5B are schematic diagrams obtained by tracing FIG. 3A, FIG. 4A, and FIG. 5A.

In FIG. 3A to FIG. 5B, a lateral direction is equivalent to the C direction. In FIG. 3A to FIG. 5B, a vertical direction is equivalent to the T direction. Reference numeral 10 illustrated in FIG. 3A to FIG. 5B indicates seamless steel pipes. Reference numeral 20 illustrated in FIG. 3A to FIG. 5B indicates Ni-plating films. That is, in FIG. 3A to FIG. 5B, interfaces between reference numeral 10 and reference numeral 20 are equivalent to the inner surfaces of the seamless steel pipes.

Referring to FIG. 3A to FIG. 5B, it can be confirmed that, in the steel material subjected only to the pickling treatment, the interface between the seamless steel pipe 10 and the Ni-plating film 20 was coarsened, compared with the steel material subjected to the blasting treatment. That is, the steel material subjected to the blasting treatment is conjectured to have a smooth surface in a microscopic view.

Here, in a case in which the surface of a steel material is coarsened, local corrosion can occur. At a location where the corrosion occurs, pH locally decreases, which will result in breakage of a passive film. In this case, active dissolution locally proceeds, thus canceling a passive state (i.e., causing depassivation). In brief, in the case where the surface of a steel material is coarsened in a microscopic view, the depassivation will occur even at a high pH, compared with a case where the surface is smooth in a microscopic view. The depassivation pH is therefore considered to be made high as a result of coarsening the surface of a steel material in a microscopic view. In this manner, the present inventors consider that although a steel material subjected only to pickling treatment has an element-depleted layer removed, there is a possibility that a depassivation pH of the steel material is made high, thereby deteriorating general corrosion resistance.

As described above, general corrosion resistance of a steel material is influenced not only by stability of a passive film that is determined according to a chemical composition of the steel material, but also presence or absence of an element-depleted layer formed on an outer layer of the steel material and a texture of the surface of the steel material. Specifically, as described above, it is conjectured that performing blasting treatment makes an inner surface of a seamless steel pipe smooth in a microscopic view. Further, it is conjectured that performing pickling treatment removes an element-depleted layer, thus forming a strong passive film over an entire surface of a seamless steel pipe. However, it is very difficult for a current technique to identify and measure each of these composite factors. However, referring to Table 1, FIG. 2A, and FIG. 2B, numerical values of depassivation pH obviously differ from one another among the steel materials subjected only to blasting treatment (the identification numbers A-2 and B-2), the steel materials subjected only to pickling treatment (the identification numbers A-3 and B-3) and the steel materials subjected to the blasting treatment and the pickling treatment (the identification numbers A-4 and B-4).

Then, in the present embodiment, a martensitic stainless seamless steel pipe is defined by regulating a depassivation pH of an inner surface of the seamless steel pipe in a case of using a specific test solution (an aqueous solution that contains 5 mass % of NaCl and 0.41 g/L of $CH_3COONa$ and further contains $CH_3COOH$).

Note that a martensitic stainless seamless steel pipe having the above described chemical composition and microstructure, satisfying FORMULA (1), and having a depassivation pH of an inner surface of the seamless steel pipe being 3.50 or less in a case of using the specific test solution shows excellent general corrosion resistance on the inner surface, and a martensitic stainless seamless steel pipe not satisfying these requirements does not show the excellent general corrosion resistance on its inner surface, which are proved from EXAMPLE described below.

A martensitic stainless seamless steel pipe according to the present embodiment completed based on the above findings includes a chemical composition consisting of, in mass %, C: 0.030% or less, Si: 1.00% or less, Mn: 1.00% or less, P: 0.030% or less, S: 0.0050% or less, Al: 0.001 to 0.100%, N: 0.0500% or less, O: 0.050% or less, Ni: 3.00 to 6.50%, Cr: more than 10.00 to 13.40%, Mo: 0.50 to 4.00%, V: 0.01 to 1.00%, Ti: 0.010 to 0.300%, Co: 0.010 to 0.300%, Ca: 0 to 0.0035%, and W: 0 to 1.50%, with the balance being Fe and impurities, and satisfying Formula (1), and a microstructure containing, in volume ratio, 80.0% or more of martensite, wherein a depassivation pH of an inner surface of the martensitic stainless seamless steel pipe is 3.50 or less in an aqueous solution that contains 5 mass % of NaCl and 0.41 g/L of $CH_3COONa$ and further contains $CH_3COOH$:

$$Cr+2.0Mo+0.5Ni+0.5Co \geq 16.0 \quad (1)$$

where, a content of a corresponding element (in mass %) is substituted for each symbol of an element in Formula (1).

The chemical composition of the above described martensitic stainless seamless steel pipe may contain Ca: 0.0010 to 0.0035%.

The chemical composition of the above described martensitic stainless seamless steel pipe may contain W: 0.10 to 1.50%.

The martensitic stainless seamless steel pipe of the present embodiment may be a seamless steel pipe for oil wells. In the present description, the term "seamless steel pipe for oil wells" means a generic term of a casing pipe, a tubing pipe, and a drilling pipe, which are used for drilling of an oil well or a gas well, collection of crude oil or natural gas, and the like.

The martensitic stainless seamless steel pipe according to the present embodiment will be described in detail below. The sign "%" following each element means mass percent unless otherwise noted.

[Chemical Composition]

The martensitic stainless seamless steel pipe according to the present embodiment has a chemical composition containing the following elements.

C: 0.030% or less

Carbon (C) is unavoidably contained. That is, C content is more than 0%. C improves hardenability of steel material, thus increasing the strength of the steel material. However, when the C content is more than 0.030%, C becomes likely to combine with Cr, thus producing Cr carbide. As a result, a Cr-depleted layer becomes likely to be formed on an outer layer of the steel material. In this case, the general corrosion resistance of the steel material will deteriorate even if the contents of other elements are within the range of the present embodiment. Accordingly, the C content is 0.030% or less. A lower limit of the C content is preferably 0.001%, more preferably 0.004%, and further preferably 0.006%. An upper limit of the C content is preferably 0.028%, and more preferably 0.026%.

Si: 1.00% or less

Silicon (Si) is unavoidably contained. That is, Si content is more than 0%. Si deoxidizes steel. However, when the Si content is more than 1.00%, the deoxidization effect will be saturated, and the hot workability of steel material will deteriorate even if the contents of other elements are within the range of the present embodiment. Therefore, the Si content is 1.00% or less. A lower limit of the Si content is preferably 0.05%, more preferably 0.10%, and further preferably 0.15%. An upper limit of the Si content is preferably 0.70%, more preferably 0.50%, and further preferably 0.40%.

Mn: 1.00% or less

Manganese (Mn) is unavoidably contained. That is, Mn content is more than 0%. Mn improves hardenability of steel material, thus increasing the strength of the steel material. However, when the Mn content is more than 1.00%, Mn produces coarse inclusions, and the toughness of steel material will deteriorate even if the contents of other elements are within the range of the present embodiment. Therefore, the Mn content is 1.00% or less. A lower limit of the Mn content is preferably 0.15%, more preferably 0.20%, and further preferably 0.30%. An upper limit of the Mn content is preferably 0.80%, more preferably 0.60%, and further preferably 0.50%.

P: 0.030% or less

Phosphorus (P) is an impurity which is unavoidably contained. That is, P content is more than 0%. P segregates at grain boundaries, thereby decreasing the toughness of steel material. Accordingly, the P content is 0.030% or less. An upper limit of the P content is preferably 0.025%, and more preferably 0.020%. The P content is preferably as low as possible. However, extremely reducing the P content will result in significant increase in production cost. Therefore, considering industrial production, a lower limit of the P content is preferably 0.001%, more preferably 0.002%, and further preferably 0.005%.

S: 0.0050% or less

Sulfur (S) is an impurity which is unavoidably contained. That is, S content is more than 0%. Like P, S segregates at grain boundaries, or combines with Mn to produce MnS, which is an inclusion. As a result, the toughness and the hot workability of steel material deteriorate. Therefore, the S content is 0.0050% or less. An upper limit of the S content is preferably 0.0030%, and more preferably 0.0020%. The S content is preferably as low as possible. However, extremely reducing the S content will result in significant increase in production cost. Therefore, considering industrial production, a lower limit of the S content is preferably 0.0001%, more preferably 0.0002%, and further preferably 0.0005%.

Al: 0.001 to 0.100%

Aluminum (Al) deoxidizes steel. When Al content is less than 0.001%, this effect cannot be obtained even if the contents of other elements are within the range of the present embodiment. On the other hand, when the Al content is more than 0.100%, coarse oxides will be formed, thus decreasing the toughness of steel material even if the contents of other elements are within the range of the present embodiment. Therefore, the Al content is 0.001 to 0.100%. A lower limit of the Al content is preferably 0.002%, more preferably 0.003%, and further preferably 0.010%. An upper limit of the Al content is preferably 0.070%, more preferably 0.050%, and further preferably 0.040%. The Al content as used in this description means the content of sol.Al (acid soluble Al).

N: 0.0500% or less

Nitrogen (N) is unavoidably contained. That is, N content is more than 0%. N forms coarse nitride, thereby decreasing the toughness of steel material. Therefore, the N content is 0.0500% or less. A lower limit of the N content is preferably 0.0010%, more preferably 0.0020%, and further preferably 0.0030%. An upper limit of the N content is preferably 0.0200%, more preferably 0.0100%, and further preferably 0.0090%.

O: 0.050% or less

Oxygen (O) is an impurity which is unavoidably contained. That is, O content is more than 0%. O forms coarse oxide inclusions, thereby decreasing the toughness of steel material. Therefore, the O content is 0.050% or less. An upper limit of the O content is preferably 0.020%, more preferably 0.010%, and further preferably 0.008%. The O content is preferably as low as possible. However, extremely reducing the O content will result in significant increase in production cost. Therefore, considering industrial production, a lower limit of the O content is preferably 0.0005%, more preferably 0.0008%.

Ni: 3.00 to 6.50%

In an enhanced mild sour environment having an $H_2S$ partial pressure of more than 0.03 to 0.1 bar, nickel (Ni) forms sulfide on the passive film. Ni sulfide suppresses chloride ions ($Cl^-$) and hydrogen sulfide ions ($HS^-$) from coming into contact with the passive film, thus suppressing the passive film from being destroyed by chloride ions and hydrogen sulfide ions. Therefore, Ni suppresses active dissolution of steel material in the enhanced mild sour environment, thereby increasing general corrosion resistance. Further, nickel (Ni) is an austenite forming element and causes the microstructure of steel material after quenching to become martensitic. When Ni content is less than 3.00%, these effects cannot be sufficiently obtained even if the contents of other elements are within the range of the present embodiment. On the other hand, when the Ni content is more than 6.50%, the $A_{c1}$ transformation point will become too low, thus making it difficult to perform thermal refining on steel material even if the contents of other elements are within the range of the present embodiment. As a result, desired mechanical properties of steel material may not be obtained. Therefore, the Ni content is 3.00 to 6.50%. A lower limit of the Ni content is preferably 4.00%, more preferably 5.00%, and further preferably 5.50%. An upper limit of the Ni content is preferably 6.30%, more preferably 6.10%, and further preferably 6.00%.

Cr: more than 10.00 to 13.40%

In an enhanced mild sour environment having an $H_2S$ partial pressure of more than 0.03 to 0.1 bar, chromium (Cr) forms the passive film on the surface of steel material, thereby increasing general corrosion resistance of the steel material. When Cr content is 10.00% or less, this effect cannot be sufficiently obtained even if the contents of other elements are within the range of the present embodiment. On the other hand, when the Cr content is more than 13.40%, δ (delta) ferrite becomes more likely to be formed in the microstructure of the steel material, thus deteriorating the toughness of steel material. Therefore, the Cr content is more than 10.00 to 13.40%. A lower limit of the Cr content is preferably 10.50%, more preferably 11.00%, further preferably 11.50%, and further preferably 12.00%. An upper limit of the Cr content is preferably 13.30%, more preferably 13.10% and further preferably 12.90%.

Mo: 0.50 to 4.00%

In an enhanced mild sour environment having an $H_2S$ partial pressure of more than 0.03 to 0.1 bar, molybdenum (Mo) forms sulfide on the passive film. Mo sulfide suppresses chloride ions ($Cl^-$) and hydrogen sulfide ions ($HS^-$) from coming into contact with the passive film, thus suppressing the passive film from being destroyed by chloride ions and hydrogen sulfide ions. Therefore, Mo suppresses active dissolution of steel material in the enhanced mild sour environment, thereby increasing general corrosion resistance. When Mo content is less than 0.50%, this effect cannot be sufficiently obtained even if the contents of other elements are within the range of the present embodiment. On the other hand, when the Mo content is more than 4.00%, austenite will hardly be stabilized, even if the contents of other elements are within the range of the present embodiment. As a result, a microstructure mainly composed of martensite will not be obtained in a stable manner. Therefore, the Mo content is 0.50 to 4.00%. A lower limit of the Mo content is preferably 0.80%, more preferably 1.30%, further preferably 1.60%, and further preferably 1.90%. An upper limit of the Mo content is preferably 3.50%, more preferably 3.00%, and further preferably 2.70%.

V: 0.01 to 1.00%

Vanadium (V) improves hardenability of steel material, thereby increasing the strength of steel material. When V content is less than 0.01%, this effect cannot be sufficiently obtained even if the contents of other elements are within the range of the present embodiment. On the other hand, when the V content is more than 1.00%, the toughness of steel material will deteriorate even if the contents of other elements are within the range of the present embodiment. Therefore, the V content is 0.01 to 1.00%. A lower limit of the V content is preferably 0.02%, more preferably 0.03%, and further preferably 0.04%. An upper limit of the V content is preferably 0.50%, more preferably 0.30%, and further preferably 0.10%.

Ti: 0.010 to 0.300%

Titanium (Ti) combines with C or N to form carbides or nitrides. In this case, coarsening of crystal grain is suppressed by the pinning effect, thereby increasing the strength of steel material. When Ti content is less than 0.010%, this effect cannot be sufficiently obtained even if the contents of other elements are within the range of the present embodiment. On the other hand, when the Ti content is more than 0.300%, δ ferrite becomes more likely to be formed, thus deteriorating the toughness of steel material. Therefore, the Ti content is 0.010 to 0.300%. A lower limit of the Ti content is preferably 0.020%, more preferably 0.040%, and further preferably 0.060%. An upper limit of the Ti content is preferably 0.250%, more preferably 0.200%, and further preferably 0.150%.

Co: 0.010 to 0.300%

Cobalt (Co) forms sulfide on a passive film in an enhanced mild sour environment having an $H_2S$ partial pressure of more than 0.03 to 0.1 bar. Co sulfide suppresses chloride ions ($Cl^-$) and hydrogen sulfide ions ($HS^-$) from coining into contact with the passive film, thus suppressing the passive film from being destroyed by chloride ions and hydrogen sulfide ions. Therefore, Co suppresses active dissolution of steel material in the enhanced mild sour environment, thereby increasing general corrosion resistance. Further, Co improves the hardenability of steel material, and ensures a stable high strength of steel material, especially during industrial production. Specifically, Co suppresses formation of residual austenite, thus suppressing the variation of strength of steel material. When Co content is less than 0.010%, these effects cannot be sufficiently obtained even if the contents of other elements are within the range of the present embodiment. On the other hand, when the Co content is more than 0.300%, the toughness of steel material deteriorates. Therefore, the Co content is 0.010 to 0.300%. A lower limit of the Co content is preferably 0.030%, more preferably 0.050%, further preferably 0.060%, further preferably 0.080%, further preferably 0.100%, further preferably 0.120%, further preferably 0.150%, and further preferably 0.160%. An upper limit of the Co content is preferably 0.270%, and more preferably 0.250%.

The balance of the martensitic stainless seamless steel pipe according to the present embodiment is Fe and impurities. Here, impurities refer to elements which, during industrial production of the martensitic stainless seamless steel pipe, are mixed from ores and scraps as the raw material, or from the production environment or the like, and which are not intentionally contained, but are allowed within a range not adversely affecting the martensitic stainless seamless steel pipe of the present embodiment.

[Regarding Optional Elements]

The chemical composition of the martensitic stainless seamless steel pipe according to the present embodiment may further contain Ca in place of part of Fe.

Ca: 0 to 0.0035%

Calcium (Ca) is an optional element and may not be contained. That is, Ca content may be 0%. When contained, Ca controls the morphology of inclusions, thereby improving the hot workability of steel material. Controlling the morphology of inclusions means making the inclusions spherical. When Ca is contained even in a small amount, this effect will be obtained to some extent. However, when the Ca content is more than 0.0035%, coarse Ca oxide is formed. In this case, the toughness of steel material deteriorates even if the contents of other elements are within the range of the present embodiment. Therefore, the Ca content is 0 to 0.0035%. A lower limit of the Ca content is preferably more than 0%, more preferably 0.0002%, further preferably 0.0008%, and further preferably 0.0010%. An upper limit of the Ca content is preferably 0.0030%, and more preferably 0.0020%.

The chemical composition of the martensitic stainless seamless steel pipe according to the present embodiment may further contain W in place of part of Fe.

W: 0 to 1.50%

Tungsten (W) is an optional element and may not be contained. That is, W content may be 0%. When contained, W stabilizes the passive film in an enhanced mild sour environment having an $H_2S$ partial pressure of more than 0.03 to 0.1 bar, thereby increasing the general corrosion resistance of steel material. When W is contained even in a small amount, this effect can be obtained to some extent. However, when the W content is more than 1.50%, W combines with C to form coarse carbides. In this case, the toughness of steel material deteriorates even if the contents of other elements are within the range of the present embodiment. Therefore, the W content is 0 to 1.50%. A lower limit of the W content is preferably 0.10%, and more preferably 0.50%. An upper limit of the W content is 1.10%, and more preferably 1.00%.

[Regarding Formula (1)]

The chemical composition of the martensitic stainless seamless steel pipe according to the present embodiment further satisfies Formula (1):

$$Cr+2.0Mo+0.5Ni+0.5Co \geq 16.0 \quad (1)$$

where, a content of a corresponding element (in mass %) is substituted for each symbol of an element in Formula (1).

Figure 6:
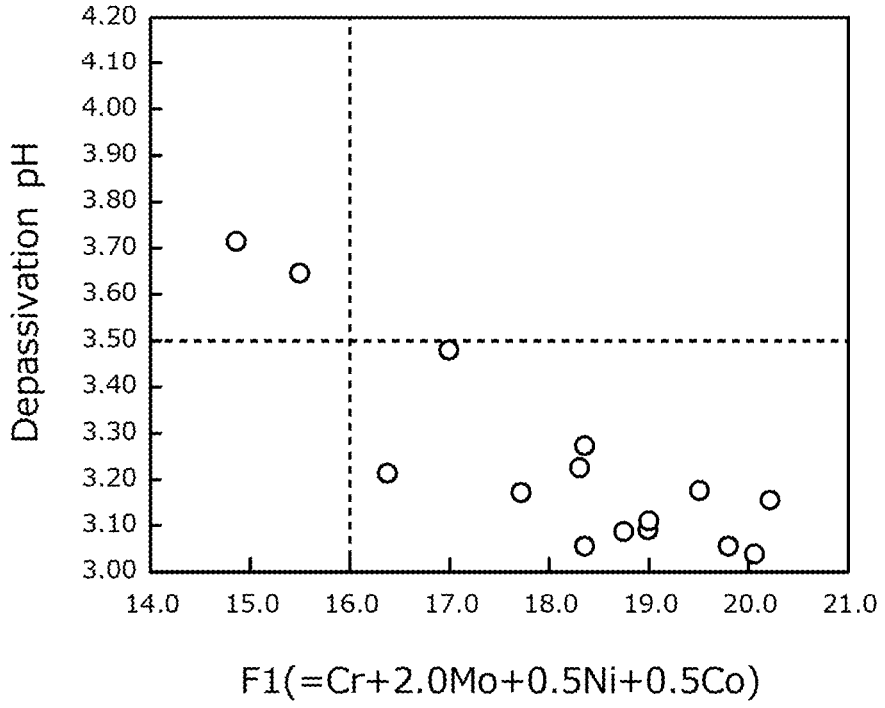
FIG. 6 is a graph illustrating the relation between F1=Cr+2.0Mo+0.5Ni+0.5Co and depassivation pH.

F1(=Cr+2.0Mo+0.5Ni+0.5Co) is an index that indicates stability of the passive film in the martensitic stainless seamless steel pipe having the above described chemical composition. Specifically, regarding a seamless steel pipe having the above described chemical composition and the above described microstructure, and produced by the preferable production method to be described below, the relation between F1 and depassivation pH (pHd) will be described with reference to the drawing. FIG. 6 is a graph illustrating the relation between F1 and depassivation pH. FIG. 6 is created using F1 and depassivation pH for a steel material having the above described chemical composition and the above described microstructure, and produced by the preferable production method to be described below, in EXAMPLE described below.

Referring to FIG. 6, in the steel material having the above described chemical composition and the above described microstructure, and produced by the preferable production method to be described below, when F1 is less than 16.0, the depassivation pH is more than 3.50. On the other hand, when F1 is 16.0 or more, the depassivation pH becomes 3.50 or less. That is, in the steel material having the above described chemical composition and microstructure and produced by the preferable production method to be described below, when F1 is 16.0 or more, the depassivation pH is 3.50 or less, showing excellent general corrosion resistance. Therefore, for the martensitic stainless seamless steel pipe according to the present embodiment, F1 is 16.0 or more.

A lower limit of F1 is preferably 17.0, more preferably 18.0, and further preferably 18.5. An upper limit of F1 is, although not particularly limited, 24.7 in a case of the chemical composition according to the present embodiment, and preferably 20.5. Note that F1 is obtained by rounding off the second decimal place of F1.

[Depassivation pH (pHd)]

As described above, in the present description, a lowest pH down to which a steel material can maintain a passive state in a specific environment is referred to as a depassivation pH in the environment. As described above, in the present description, the depassivation pH is also denoted as "pHd". If pH of an environment to which a steel material is exposed falls below the depassivation pH, the passive film of the steel material is broken, active dissolution proceeds, and general corrosion proceeds. The lower the depassivation pH, the passive film can be maintained even in a sour environment having a low pH, increasing general corrosion resistance.

In the martensitic stainless seamless steel pipe according to the present embodiment, the inner surface has a depassivation pH of 3.50 or less in an aqueous solution that contains 5 mass % of NaCl and 0.41 g/L of $CH_3COONa$ and further contains $CH_3COOH$. In the present description, the "aqueous solution that contains 5 mass % of NaCl and 0.41 g/L of $CH_3COONa$ and further contains $CH_3COOH$" is also referred to as a "specific test solution".

The martensitic stainless seamless steel pipe according to the present embodiment can be made to have a depassivation pH of 3.50 or less in the specific test solution by causing the martensitic stainless seamless steel pipe to have the above described chemical composition satisfying Formula (1), reducing an element-depleted layer in the outer layer of its inner surface, and making the outer layer of the inner surface smooth in a microscopic view. Note that, as will be described in the preferable production method to be described below, in the present embodiment, the element-depleted layer in the outer layer of the inner surface can be reduced and the outer layer of the inner surface can be made smooth in a microscopic view by performing both the blasting treatment and the pickling treatment. In this manner, the inner surface of the martensitic stainless seamless steel pipe according to the present embodiment can be made to have a depassivation pH of 3.50 or less.

Further, as described above, the general corrosion resistance of a steel material is influenced by not only stability of the passive film that is determined according to the chemical composition of the steel material, but also presence or absence of the element-depleted layer formed on the outer layer of the steel material and the texture of the surface of the steel material. However, it is very difficult for a current technique to identify and measure each of these composite factors. Then, in the present embodiment, as described above, the depassivation pH in the case of using the specific test solution (the aqueous solution that contains 5 mass % of NaCl and 0.41 g/L of $CH_3COONa$ and further contains $CH_3COOH$) will be regulated.

Note that, as described above, the martensitic stainless seamless steel pipe having the above described chemical composition and microstructure, satisfying Formula (1), and having a depassivation pH of 3.50 or less in the case of using the specific test solution shows excellent general corrosion resistance, and a martensitic stainless seamless steel pipe not satisfying these requirements does not show the excellent general corrosion resistance, which is proved from EXAMPLE described below.

[Measurement Method of Depassivation pH]

The depassivation pH (pHd) can be measured by the following method. Test specimens each in which only a region equivalent to an inner surface of a martensitic stainless seamless steel pipe is exposed are fabricated. Specifically, test specimens each of which includes the inner surface of the martensitic stainless seamless steel pipe are taken. The size of the test specimens is not particularly limited. For example, the test specimens may be disk-shaped test specimens having a thickness of 1 mm and a diameter of 15 mm or may be plate-shaped test specimens. A coating is formed in a region of each test specimen other than the region equivalent to the inner surface of the martensitic stainless seamless steel pipe. The coating is not particularly limited as long as the coating is inactive to corrosion in the enhanced mild sour environment. The coating is, for example, a resin coating. In this manner, test specimens each in which only a region equivalent to an outer layer portion of a martensitic stainless seamless steel pipe is exposed are fabricated. Note that the test specimens are to be energized in electrochemical measurement to be described below. For that reason, when a nonconductive coating such as resin coating is to be formed, conductors for the energization are connected to given portions in the region other than the region equivalent to the inner surface of each test specimen.

A plurality of specific test solutions that contain 5 mass % of NaCl (sodium chloride) and 0.41 g/L of $CH_3COONa$ (sodium acetate) and further contain $CH_3COOH$ (acetic acid) at concentrations different from one another are prepared. The pHs of the prepared specific test solutions are measured with a pH meter, and pHs of the specific test solutions are thereby determined. A plurality of specific test solutions having pHs substantially with a 0.2 pitch are prepared.

In each of the specific test solutions, the rest potential of each test specimen is measured by the following method. First, an electrolytic bath is prepared. As the electrolytic bath, a glass-made cell (800 mL) is used. Each specific test solution is poured into the electrolytic bath, and the electrolytic bath is deaerated for one hour or more with high purity Ar. After the deaeration, a test gas (having an $H_2S$ partial pressure of 0.1 bar, with the balance being $CO_2$) is injected for 30 minutes or more, making the electrolytic bath saturated with the test gas. In the test, the specific test solution is held at a normal temperature (24±3C), and the electrolytic bath is brought into an air-tight state. Platinum is used as a counter electrode, and a saturated calomel electrode (SCE) is used as a reference electrode. Each test specimen is immediately immersed into the test solution, and the rest potential is measured using a potentiostat. During the test, the above described test gas is injected into the test solution at a flow rate of about 10 mL/min to maintain the saturation.

After the elapse of four hours, at which the rest potential becomes stable sufficiently, the rest potential is measured. Test specimens corresponding to the specific test solutions having pHs substantially with a 0.2 pitch are prepared, and the rest potentials of the test specimens in the specific test solutions are determined. The relation between the determined rest potentials and pHs of the specific test solutions is plotted.

Figure 7:
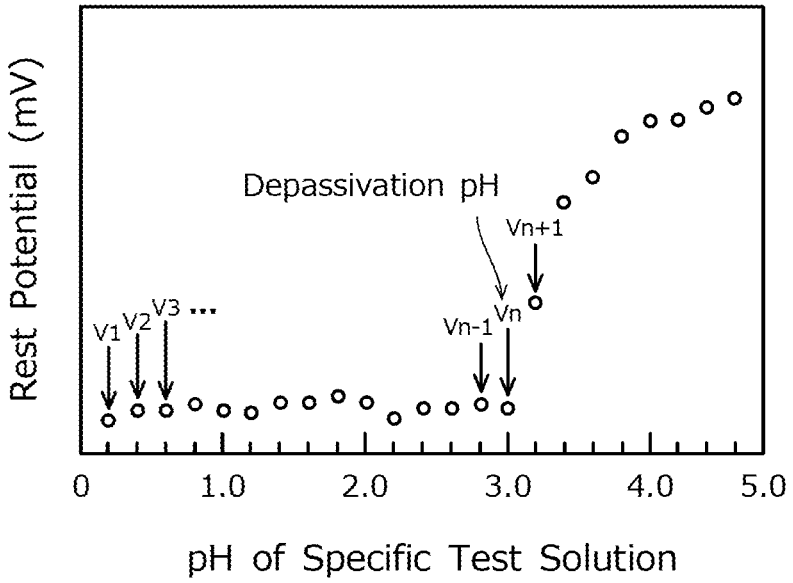
FIG. 7 is a diagram for illustrating a measurement method of depassivation pH.

FIG. 7 is a graph illustrating an example of the relation between the determined rest potentials and pHs of the specific test solutions. Referring to FIG. 7, the pH immediately before the rest potential surges is defined as a "depassivation pH". More specifically, referring to FIG. 7, a specific test solution having a lowest pH is defined as a first specific test solution, and specific test solutions in ascending pH order from the first specific test solution are defined as a second specific test solution, a third specific test solution, and an n-th specific test solution. The rest potential of the first specific test solution is defined as V1, the rest potential of the second specific test solution is defined as V2, the rest potential of the n-th specific test solution is defined as Vn, and the rest potential of an n+1-th specific test solution is defined as Vn+1. In FIG. 7, the rest potential is significantly increased from the rest potential Vn to the rest potential Vn+1, and potential differences between the rest potential Vn and the rest potential Vn+1 and the subsequent rest potentials (Vn+1, Vn+2, Vn+3, . . . ) are significantly large, compared with potential differences between the rest potential Vn and a rest potential Vn−1 and the previous rest potentials (Vn−1, Vn−2, Vn−3, . . . ). In this case, the pH of the n-th specific test solution is defined as the "depassivation pH".

[Microstructure]

The microstructure of the martensitic stainless seamless steel pipe according to the present embodiment is mainly composed of martensite. In the present description, the term "martensite" includes not only fresh martensite but also tempered martensite. Moreover, in the present description, the phrase "mainly composed of martensite" means that the volume ratio of martensite is 80.0% or more in the microstructure. The balance of the microstructure is retained austenite. That is, the volume ratio of retained austenite is 0 to 20.0% in the martensitic stainless seamless steel pipe of the present embodiment. The volume ratio of retained austenite is preferably as low as possible. A lower limit of the volume ratio of martensite in the microstructure of the martensitic stainless seamless steel pipe of the present embodiment is preferably 85.0%, and more preferably 90.0%. Further preferably, the microstructure of the steel material is of a martensite single phase.

In the microstructure, a small amount of retained austenite does not cause a significant decrease in strength and significantly increases the toughness of steel material. However, if the volume ratio of retained austenite is too high, the strength of steel material significantly decreases. Therefore, as described above, the volume ratio of retained austenite is 0 to 20.0% in the microstructure of the martensitic stainless seamless steel pipe of the present embodiment. In viewpoint of ensuring strength, an upper limit of the volume ratio of retained austenite is preferably 15.0%, and more preferably 10.0%. As described above, the microstructure of the martensitic stainless seamless steel pipe of the present embodiment may be of a martensite single phase. Therefore, the volume ratio of retained austenite may be 0%. On the other hand, when even a small amount of retained austenite is present, the volume ratio of retained austenite is more than 0 to 20.0% or less, more preferably more than 0 to 15.0%, and further preferably more than 0 to 10.0%.

[Measurement Method of Volume Ratio of Martensite]

The volume ratio (vol. %) of martensite in the microstructure of the martensitic stainless seamless steel pipe of the present embodiment is obtained by subtracting the volume ratio (vol. %) of retained austenite, which is obtained by the following method, from 100.0%.

The volume ratio of retained austenite is obtained by an X-ray diffraction method. Specifically, test specimens are taken from the center portion of the wall thickness of the martensitic stainless seamless steel pipe. The size of the test specimens is, although not particularly limited, 15 mm×15 mm×a thickness of 2 mm. In this case, the thickness direction of the test specimens is the pipe diameter direction. By using the obtained test specimen, X-ray diffraction intensity of each of the (200) plane of α phase (ferrite and martensite), the (211) plane of α phase, the (200) plane of γ phase (retained austenite), the (220) plane of γ phase, and the (311) plane of γ phase is measured to calculate an integrated intensity of each plane. In the measurement of the X-ray diffraction intensity, the target of the X-ray diffraction apparatus is Mo (MoKα ray), and the output thereof is 50 kV-40 mA. After calculation, the volume ratio Vγ (%) of retained austenite is calculated using Formula (I) for combinations (2×3=6 pairs) of each plane of the α phase and each plane of the γ phase. Then, an average value of the volume ratios Vγ of retained austenite of the six pairs is defined as the volume ratio (%) of retained austenite.

$$V\gamma=100/\{1+(I\alpha\times R\gamma)/(I\gamma\times R\alpha)\} \quad \text{(I)}$$

Where, Iα is an integrated intensity of a phase. Rα is a crystallographic theoretical calculation value of a phase. Iγ is an integrated intensity of γ phase. Rγ is a crystallographic theoretical calculation value of γ phase. In the present description, Rα in the (200) plane of α phase is 15.9, Rα in the (211) plane of a phase is 29.2, and Rγ in the (200) plane of γ phase is 35.5, Rγ in the (220) plane of γ phase is 20.8, and Rγ in the (311) plane of γ phase is 21.8. Note that the volume ratio of retained austenite is obtained by rounding off the second decimal place of an obtained numerical value.

Using the volume ratio (%) of retained austenite obtained by the above described X-ray diffraction method, the volume ratio (vol. %) of martensite of the microstructure of martensitic stainless seamless steel pipe is obtained by the following Formula.

Volume ratio of martensite=100.0−volume ratio of retained austenite (%)

[Prior-Austenite Grain Diameter]

In the martensitic stainless seamless steel pipe according to the present embodiment, a prior-austenite grain diameter (hereinafter, also referred to as a "prior γ grain diameter") is not particularly limited. The prior γ grain diameter is preferably 20 μm or less. As the prior γ grain diameter becomes small, the yield strength of steel material increases.

In the present embodiment, the prior γ grain diameter can be obtained by the following method. A test specimen for microstructure observation is taken from the center portion of the wall thickness of the seamless steel pipe according to the present embodiment. The test specimen is not particularly limited as long as the test specimen has an observation surface measuring 10 mm in the T direction (pipe diameter direction) and 10 mm in the C direction (the direction perpendicular to the L direction and the T direction). The observation surface of the test specimen is equivalent to a cross section that is perpendicular to the L direction (pipe axis direction) of the seamless steel pipe. After the observation surface of the test specimen embedded in resin is mirror-polished, the test specimen is immersed in the Vilella's reagent (a mixed solution of ethanol, hydrochloric acid, and picric acid) for about 60 seconds and then etched, by which prior-austenite grain boundaries are exposed.

Ten visual fields in the etched observation surface are observed under an optical microscope, and photographic images are created. Image processing is performed on the created photographic images to obtain the areas of prior-austenite grains. From the obtained areas, circle equivalent diameters of the prior-austenite grains are obtained. The arithmetic mean value of the circle equivalent diameters of the prior-austenite grains obtained from the ten visual fields is defined as the prior γ grain diameter (μm). Note that the prior γ grain diameter is obtained by rounding off the first decimal place of an obtained numerical value.

[Yield Strength]

The yield strength of the martensitic stainless seamless steel pipe of the present embodiment is not particularly limited. The yield strength is preferably 655 MPa or more (95 ksi or more). The yield strength is preferably 758 MPa or more (110 ksi or more). An upper limit of the yield strength is, although not particularly limited, for example 1000 MPa in a case of the chemical composition according to the present embodiment.

In the present description, the yield strength means 0.2% offset proof stress (MPa) which is obtained by a tensile test at a normal temperature (24±3° C.) in conformity with ASTM E8/E8M (2013). Specifically, the yield strength is obtained by the following method. Tensile test specimens are taken from the center portion of the wall thickness of the martensitic stainless seamless steel pipe. The tensile test specimen is, for example, a round bar tensile test specimen having a parallel portion diameter of 6.0 mm and a parallel portion length of 40.0 mm. The longitudinal direction of the parallel portion of the round bar tensile test specimen is parallel with the pipe axis direction of the martensitic stainless seamless steel pipe. By using the round bar tensile test specimen, a tensile test is conducted at a normal temperature (24±3° C.) in conformity with ASTM E8/E8M (2013) to obtain 0.2% offset proof stress (MPa), and the obtained 0.2% offset proof stress is defined as the yield strength (MPa).

[Uses of Martensitic Stainless Seamless Steel Pipe]

Uses of the martensitic stainless seamless steel pipe according to the present embodiment are not particularly limited. The martensitic stainless seamless steel pipe according to the present embodiment is suitable for a seamless steel pipe for oil wells. Examples of the seamless steel pipe for oil wells include a casing pipe, a tubing pipe, a drilling pipe, and the like, which are used for drilling of an oil well or a gas well, collection of crude oil or natural gas, and the like.

[Production Method]

An example of the production method of the martensitic stainless seamless steel pipe of the present embodiment will be described. Note that the production method to be described below is an example, and the production method of a martensitic stainless seamless steel pipe of the present embodiment will not be limited thereto. That is, as long as a martensitic stainless seamless steel pipe of the present embodiment having the above described configuration can be produced, the production method will not be limited to the production method to be described below. However, the production method to be described below is a preferable production method for producing a martensitic stainless seamless steel pipe of the present embodiment.

An example of the production method of the martensitic stainless seamless steel pipe of the present embodiment includes a process (hollow shell preparation process) of preparing a hollow shell and a process (posttreatment process) of performing posttreatment on the hollow shell. The processes will be described below in detail.

[Hollow Shell Preparation Process]

In the hollow shell preparation process, a hollow shell having the above described chemical composition satisfying Formula (1) is prepared. The production method is not particularly limited as long as the hollow shell has the above described chemical composition satisfying Formula (1) and a microstructure mainly composed of martensite. As the hollow shell, one provided from a third party may be used, or one produced by a hollow shell production process described below may be used.

[Hollow Shell Production Process]

The hollow shell production process includes a starting material preparation process, a hot working process, and a heat treatment process. Hereinafter, each step will be described.

[Starting Material Preparation Process]

In the starting material preparation process, first, molten steel having the above described chemical composition satisfying Formula (1) is produced by a well-known refining method. By using the produced molten steel, a cast piece is produced through a continuous casting process. Here, the cast piece is a slab, a bloom, or a billet. In place of the cast piece, an ingot may be produced by an ingot-making process using the above described molten steel. As needed, the slab, the bloom, or the ingot may be subjected to hot rolling to produce a billet. The starting material (slab, bloom, or billet) is produced by the above described production process.

[Hot Working Process]

In the hot working process, the prepared starting material is subjected to hot working. First, the starting material is heated in a heating furnace. The heating temperature is, although not particularly limited, for example, 1100 to 1300° C. The starting material extracted from the heating furnace is subjected to hot working to produce a hollow shell (seamless steel pipe). For example, the Mannesmann process is performed as the hot working to produce a hollow shell. In this case, the billet is subjected to piercing-rolling by a piercing machine. When performing piercing-rolling, piercing ratio is, although not particularly limited, for example, 1.0 to 4.0. The billet after piercing-rolling is subjected to drawing and rolling using a mandrel mill. As needed, the billet after drawing and rolling is further subjected to diameter adjusting rolling using a reducer or a sizing mill. The hollow shell is produced by the above described processes. A cumulative reduction of area in the hot working process is, although not particularly limited, for example, 20 to 70%.

The hollow shell may be produced from a billet by a hot working method other than the Mannesmann process. For example, in the case of a short-sized, thick-wall steel material like a coupling, the hollow shell may be produced by forging such as the Erhard method etc., or the hollow shell may be produced by the hot extrusion method.

[Heat Treatment Process]

The heat treatment process includes a quenching process and a tempering process.

[Quenching Process]

In the heat treatment process, first, the steel material produced in the hot working process is subjected to quenching (quenching process). Quenching is carried out in a well-known method. Specifically, the steel material after hot working is loaded into a heat treatment furnace and is held at a quenching temperature. The quenching temperature is not lower than the $A_{C3}$ transformation point and is, for example, 900 to 1000° C. After holding the steel material at the quenching temperature, it is rapidly cooled (quenched). The holding time at the quenching temperature is, although not particularly limited, for example, 10 to 60 minutes. The quenching method is, for example, water cooling. The quenching method is not particularly limited. For example, the hollow shell may be rapidly cooled by immersing it in a water bath or oil bath, or the hollow shell may be rapidly cooled by pouring or jetting cooling water to the outer surface and/or the inner surface of the hollow shell by means of shower cooling or mist cooling.

Note that, quenching (direct quenching) may be performed immediately after hot working without cooling the hollow shell to a normal temperature after the hot working, or quenching may be performed after holding the hollow shell at a quenching temperature by loading it into a supplementary heating furnace before the temperature of the hollow shell after hot working declines.

The quenching temperature described above means a furnace temperature in the case of using the heat treatment furnace or the supplementary heating furnace and means the temperature of the outer surface of the hollow shell in the case of direct quenching. The holding time means an in-furnace time (a time from loading the hollow shell into the heat treatment furnace or the supplementary heating furnace until extracting it).

[Tempering Process]

The hollow shell after quenching is further subjected to a tempering process. In the tempering process, the yield strength of the hollow shell is adjusted. For the martensitic stainless seamless steel pipe of the present embodiment, a tempering temperature is 500° C. to the $A_{C1}$ transformation point. A lower limit of the tempering temperature is preferably 510° C., and more preferably 520° C. An upper limit of the tempering temperature is preferably 630° C., and more preferably 620° C. The holding time at the tempering temperature is, although not particularly limited, for example, 10 to 180 minutes. The yield strength of the martensitic stainless seamless steel pipe having the above described chemical composition satisfying Formula (1) can be adjusted by appropriately adjusting the tempering temperature depending on the chemical composition. Preferably, the tempering condition is adjusted such that the yield strength of the martensitic stainless seamless steel pipe is 655 MPa or more.

The tempering temperature described above means the furnace temperature (° C.) of the heat treatment furnace, and the holding time at the tempering temperature means the in-furnace time (the time from loading the hollow shell into the heat treatment furnace until extracting it).

The hollow shell can be produced by the above described processes.

[Posttreatment Process]

The hollow shell prepared by the hollow shell preparation process is subjected to blasting treatment and pickling treatment. Note that the pickling treatment includes a first pickling process and a second pickling process. Hereinafter, a blasting process of performing the blasting treatment, and the first pickling process, and the second pickling process will be described in detail.

[Blasting Process]

In the blasting process, the blasting treatment is performed on the inner surface of the prepared hollow shell. In the blasting process, the blasting treatment is performed to remove scales formed in the above described heat treatment process by mechanically grinding the scales. Further, in the blasting process, the inner surface of the hollow shell is made smooth in a microscopic view. As a result, the inner surface of the seamless steel pipe after the pickling treatment to be described below is made smooth in a microscopic view, thereby increasing general corrosion resistance. Preferably, the blasting treatment is performed also on the outer surface of the hollow shell. In this case, not only the inner surface but also the outer surface of the seamless steel pipe after a pickling process to be described below has excellent general corrosion resistance.

In the blasting process, the kind of the blasting treatment is not particularly limited as long as the surface of the hollow shell can be mechanically ground. The blasting treatment performed in the blasting process may be, for example, shotblast, sandblast, or shotpeening. The blasting treatment performed in the blasting process is preferably shotblast.

Specifically, in the blasting process, blast media are blasted against the inner surface of the hollow shell. Examples of the blast media include steel, cast steel, stainless steel, glass, silica sand, alumina, amorphous media, zirconia, and the like. The shape of the blast media may be spherical, or may be cut-wire, round-cut-wire, or grit. As the method of blasting the blast media, the blast media may be blasted against the surface of the steel material using compressed air, centrifugal force produced by a vane wheel (impeller type), high-pressure water, ultrasonic wave, and the like. For those skilled in the art, it is possible to adjust the conditions of the blasting treatment appropriately to remove the scale appropriately.

As described above, in the blasting process, the scales are removed from the inner surface of the hollow shell, and the inner surface of the hollow shell can be made smooth in a microscopic view. On the other hand, in the blasting process, it is difficult to completely remove the element-depleted layer from the outer layer of the inner surface of the hollow shell. Therefore, in the preferable production method of a martensitic stainless seamless steel pipe according to the present embodiment, a remaining element-depleted layer is removed by the first pickling process described below. Hereinafter, the first pickling process will be described in detail.

[First Pickling Process]

In the first pickling process, pickling treatment using sulfuric acid solution is performed on the hollow shell subjected to the blasting treatment. Specifically, a sulfuric acid bath that stores sulfuric acid solution is prepared. The sulfuric acid solution is an aqueous solution that contains, for example, sulfuric acid at a concentration of, in mass %, 5.0 to 30.0%. The temperature of the sulfuric acid solution in the sulfuric acid bath is adjusted to 50.0 to 80.0° C., and the hollow shell is immersed in the sulfuric acid bath. The time of the immersion of the hollow shell in the sulfuric acid bath is, for example, 20 to 40 minutes. By immersing the hollow shell in the sulfuric acid bath, the element-depleted layer on the surface of the hollow shell is removed. After elapse of the above described time of the immersion, the hollow shell is pulled up from the sulfuric acid bath and is immersed in a rinse bath that stores water to rinse the hollow shell.

[Second Pickling Process]

In the second pickling process, pickling treatment using a mixed acid of nitric acid and hydrofluoric acid is performed on the hollow shell subjected to the pickling treatment using the sulfuric acid solution in the first pickling process. Specifically, a treatment bath that stores treatment solution is prepared. The treatment solution contains nitric acid and hydrofluoric acid. The nitric acid content of the treatment solution is, for example, 5.0 to 15.0% by mass. The hydrofluoric acid content of the treatment solution is, for example, 2.0 to 7.0% by mass. The treatment solution is an aqueous solution containing nitric acid and hydrofluoric acid.

The temperature of the treatment solution in the treatment bath is adjusted to a normal temperature (24±3C) to 50° C., and the hollow shell is immersed in the treatment bath. The time of the immersion of the hollow shell in the treatment bath is, for example, 1 to 10 minutes. By immersing the hollow shell in the treatment bath, the surface of the hollow shell is activated. As a result, a strong passive film is formed on the surface of the steel material after rinsing described below. Further, as a result, the passive film on the surface of the steel material becomes likely to be formed uniformly.

After elapse of the above described time of the immersion, the hollow shell is pulled up from the treatment bath and is immersed in a rinse bath that stores water to rinse the hollow shell. The method of rinsing is not particularly limited and may be any known method. For example, as in the first pickling process, the hollow shell may be immersed in the rinse bath that stores water. Further, for example, shower rinsing using high-pressure water may be performed.

By performing the above described blasting process, and first pickling process and second pickling process, the scales and the element-depleted layer on the outer layer of the steel material are sufficiently removed, and the strong passive film becomes likely to be formed uniformly. In this case, the surface of the steel material is further made smooth in a microscopic view. As a result, the inner surface of the martensitic stainless seamless steel pipe according to the present embodiment has a depassivation pH of 3.50 or less in the specific test solution. As a result, the martensitic stainless seamless steel pipe of the present embodiment includes an inner surface having excellent general corrosion resistance even in an enhanced mild sour environment having an $H_2S$ partial pressure of more than 0.03 to 0.1 bar.

On the other hand, in a case in which only the blasting treatment is performed on the hollow shell, although the scales on the inner surface of the seamless steel pipe are removed, the element-depleted layer in the outer layer of the inner surface of the seamless steel pipe is not removed sufficiently, and a stable passive film is not formed. On the other hand, in a case in which only the pickling treatment is performed on the hollow shell, although the element-depleted layer in the outer layer of the inner surface of the seamless steel pipe is removed and a stable passive film is formed uniformly, the inner surface of the seamless steel pipe becomes rough in a microscopic view. Therefore, if only the blasting treatment or only the pickling treatment is performed on the hollow shell, the depassivation pH of the inner surface of the obtained seamless steel pipe is more than 3.50 in the specific test solution, and thus excellent general corrosion resistance is not obtained.

EXAMPLE

Molten steels having chemical compositions shown in Table 2 were produced.

TABLE 2

| | Chemical composition (in mass %, balance being Fe and impurities) | | | | | | | | |
|---|---|---|---|---|---|---|---|---|---|
| Steel | C | Si | Mn | P | S | Al | N | O | Ni |
| A | 0.010 | 0.35 | 0.45 | 0.016 | 0.0005 | 0.028 | 0.0048 | <0.001 | 5.99 |
| B | 0.011 | 0.25 | 0.43 | 0.015 | 0.0005 | 0.032 | 0.0072 | <0.001 | 5.97 |
| C | 0.027 | 0.19 | 0.40 | 0.011 | 0.0005 | 0.025 | 0.0069 | <0.001 | 5.10 |
| D | 0.028 | 0.28 | 0.36 | 0.014 | 0.0011 | 0.031 | 0.0007 | <0.001 | 5.41 |
| E | 0.017 | 0.27 | 0.35 | 0.018 | 0.0010 | 0.037 | 0.0039 | <0.001 | 6.15 |
| F | 0.026 | 0.28 | 0.37 | 0.012 | 0.0005 | 0.034 | 0.0019 | <0.001 | 5.42 |
| G | 0.024 | 0.28 | 0.37 | 0.013 | 0.0015 | 0.049 | 0.0020 | <0.001 | 5.64 |
| H | 0.019 | 0.39 | 0.44 | 0.011 | 0.0010 | 0.027 | 0.0013 | 0.005 | 4.94 |
| I | 0.019 | 0.32 | 0.40 | 0.016 | 0.0016 | 0.030 | 0.0063 | <0.001 | 5.35 |
| J | 0.024 | 0.30 | 0.31 | 0.013 | 0.0008 | 0.040 | 0.0092 | 0.003 | 6.07 |
| K | 0.021 | 0.39 | 0.43 | 0.013 | 0.0016 | 0.046 | 0.0027 | <0.001 | 4.93 |
| L | 0.019 | 0.34 | 0.38 | 0.012 | 0.0016 | 0.034 | 0.0052 | <0.001 | 4.88 |
| M | 0.020 | 0.18 | 0.32 | 0.018 | 0.0007 | 0.021 | 0.0010 | <0.001 | 5.00 |
| N | 0.025 | 0.25 | 0.39 | 0.016 | 0.0019 | 0.036 | 0.0024 | <0.001 | 2.15 |
| O | 0.027 | 0.39 | 0.33 | 0.011 | 0.0017 | 0.034 | 0.0099 | <0.001 | 4.66 |
| P | 0.025 | 0.22 | 0.41 | 0.010 | 0.0018 | 0.031 | 0.0028 | <0.001 | 4.90 |
| Q | 0.011 | 0.24 | 0.38 | 0.015 | 0.0008 | 0.033 | 0.0063 | <0.001 | 5.32 |
| R | 0.015 | 0.20 | 0.40 | 0.009 | 0.0012 | 0.046 | 0.0036 | <0.001 | 4.21 |

| | Chemical composition (in mass %, balance being Fe and impurities) | | | | | | | |
|---|---|---|---|---|---|---|---|---|
| Steel | Cr | Mo | V | Ti | Co | Ca | W | F1 |
| A | 11.80 | 2.49 | 0.06 | 0.069 | 0.221 | — | — | 19.9 |
| B | 11.77 | 0.80 | 0.05 | 0.104 | 0.203 | — | — | 16.5 |
| C | 12.20 | 1.80 | 0.03 | 0.093 | 0.243 | — | — | 18.5 |
| D | 11.72 | 1.64 | 0.04 | 0.126 | 0.180 | — | — | 17.8 |
| E | 12.60 | 2.26 | 0.04 | 0.115 | 0.205 | — | — | 20.3 |
| F | 13.24 | 1.77 | 0.05 | 0.024 | 0.181 | — | — | 19.6 |
| G | 11.30 | 2.11 | 0.07 | 0.013 | 0.188 | — | — | 18.4 |
| H | 12.94 | 1.66 | 0.05 | 0.132 | 0.165 | — | — | 18.8 |
| I | 11.97 | 2.16 | 0.03 | 0.054 | 0.178 | — | — | 19.1 |
| J | 12.41 | 2.30 | 0.03 | 0.087 | 0.202 | — | — | 20.1 |

TABLE 2-continued

| | | | | | | | | |
|---|---|---|---|---|---|---|---|---|
| K | 11.42 | 1.54 | 0.04 | 0.089 | 0.164 | 0.0004 | — | 17.0 |
| L | 11.62 | 2.46 | 0.04 | 0.109 | 0.163 | — | 0.53 | 19.1 |
| M | 12.15 | 1.82 | 0.07 | 0.090 | 0.167 | 0.0010 | 0.55 | 18.4 |
| N | 11.36 | 1.52 | 0.04 | 0.105 | 0.102 | — | — | 15.5 |
| O | 7.82 | 2.18 | 0.03 | 0.036 | 0.156 | — | — | 14.6 |
| P | 12.56 | 0.30 | 0.03 | 0.040 | 0.172 | — | — | 15.7 |
| Q | 11.53 | 0.65 | 0.04 | 0.101 | 0.225 | — | — | 15.6 |
| R | 10.31 | 1.21 | 0.06 | 0.089 | 0.133 | — | — | 14.9 |

The symbol "-" in Table 2 means that the content of a corresponding element was less than a detection limit. The symbol "<" in Table 2 means that the content of a corresponding element was less than a described numerical value. The above described molten steels each 50 kg in weight were melted in the vacuum furnace, and ingots were produced by an ingot-making process. The ingots were heated to 1250° C. for 3 hours. The ingots after heating were subjected to hot forging to produce blocks. The blocks after hot forging were held at 1230° C. for 15 minutes and subjected to hot rolling. In this manner, steel materials (plate materials) having a thickness of 13 mm, simulating seamless steel pipes, were produced. Note that, one of the surfaces of each steel material that was perpendicular to the thickness direction of the steel material was determined as a surface simulating an inner surface of a seamless steel pipe (hereinafter, also referred to as a "simulated surface").

For the steel material of each test number, quenching was performed. In any test number, the quenching temperature was 900° C., and in any test number, the holding time at the quenching temperature was 15 minutes. The quenched steel material of each test number was subjected to tempering in which the steel material was held at tempering temperature of 560° C. for 30 minutes.

The tempered steel material of each test number was subjected to the blasting treatment and the pickling treatment. In the blasting treatment, shotblast was performed on the simulated surface. As the blast media, alumina having a grain size number of #14 was used. The presence or absence of performing the blasting treatment on the steel material of each test number is shown in Table 3. Specifically, the term "Performed" in the "Blasting treatment" column in Table 3 means that the blasting treatment was performed. The symbol "-" in the "Blasting treatment" column in Table 3 means that the blasting treatment was not performed.

Subsequently, the steel material of each test number was subjected to the pickling treatment. In the pickling treatment, as described in the above described preferable production method, the two-stage pickling treatment was performed. Specifically, the following processes were performed. First, the steel material was immersed in a sulfuric acid solution at 60° C. containing 20.0 mass % of sulfuric acid for 30 minutes. After elapse of the immersion time, the steel material was pulled up from the sulfuric acid solution and rinsed. The rinsed steel material was immersed in treatment solution at a normal temperature (24±3C) containing 5.0 mass % of hydrofluoric acid and 10.0 mass % of nitric acid for 3 minutes. After elapse of the immersion time, the steel material was rinsed. The presence or absence of performing the pickling treatment on the steel material of each test number is shown in Table 3. Specifically, the term "Performed" in the "Pickling treatment" column in Table 3 means that the above described pickling treatment was performed. The symbol "-" in the "Pickling treatment" column in Table 3 means that the pickling treatment was not performed.

TABLE 3

| Test No. | Steel | F1 | Blasting treatment | Pickling treatment | Martensite volume ratio (%) | pHd |
|---|---|---|---|---|---|---|
| 1 | A | 19.9 | Performed | Performed | ≥80.0 | 3.05 |
| 2 | B | 16.5 | Performed | Performed | ≥80.0 | 3.21 |
| 3 | C | 18.5 | Performed | Performed | ≥80.0 | 3.27 |
| 4 | D | 17.8 | Performed | Performed | ≥80.0 | 3.17 |
| 5 | E | 20.3 | Performed | Performed | ≥80.0 | 3.15 |
| 6 | F | 19.6 | Performed | Performed | ≥80.0 | 3.18 |
| 7 | G | 18.4 | Performed | Performed | ≥80.0 | 3.06 |
| 8 | H | 18.8 | Performed | Performed | ≥80.0 | 3.09 |
| 9 | I | 19.1 | Performed | Performed | ≥80.0 | 3.11 |
| 10 | J | 20.1 | Performed | Performed | ≥80.0 | 3.04 |
| 11 | K | 17.0 | Performed | Performed | ≥80.0 | 3.49 |
| 12 | L | 19.1 | Performed | Performed | ≥80.0 | 3.09 |
| 13 | M | 18.4 | Performed | Performed | ≥80.0 | 3.22 |
| 14 | N | 15.5 | Performed | Performed | ≥80.0 | 3.67 |
| 15 | O | 14.6 | Performed | Performed | ≥80.0 | 3.77 |
| 16 | P | 15.7 | Performed | Performed | ≥80.0 | 3.69 |
| 17 | Q | 15.6 | Performed | Performed | ≥80.0 | 3.65 |
| 18 | R | 14.9 | Performed | Performed | ≥80.0 | 3.72 |
| 19 | A | 19.9 | Performed | — | ≥80.0 | 3.51 |
| 20 | B | 16.5 | Performed | — | ≥80.0 | 3.60 |
| 21 | C | 18.5 | Performed | — | ≥80.0 | 3.69 |
| 22 | A | 19.9 | — | Performed | ≥80.0 | 3.67 |
| 23 | B | 16.5 | — | Performed | ≥80.0 | 3.82 |
| 24 | A | 19.9 | — | — | ≥80.0 | 3.88 |
| 25 | B | 16.5 | — | — | ≥80.0 | 4.02 |

[Evaluation Test]

The steel material produced through the above producing step was subjected to the following evaluation test.

[Measurement Test of Martensite Volume Ratio]

From a center portion of the thickness of the steel material of each test number, a test specimen measuring 15 mm×15 mm×a thickness of 2 mm was taken. The thickness direction of the test specimen corresponded to the thickness direction of the steel material (i.e., the direction perpendicular to the simulated surface). By using the obtained test specimen, X-ray diffraction intensity of each of the (200) plane of α phase (ferrite and martensite), the (211) plane of α phase, the (200) plane of γ phase (retained austenite), the (220) plane of γ phase, and the (311) plane of γ phase was measured to calculate an integrated intensity of each plane. In the measurement of the X-ray diffraction intensity, the target of the X-ray diffraction apparatus was Mo (MoKα ray), and the output thereof was 50 kV-40 mA. After calculation, the volume ratio Vγ(%) of retained austenite was calculated using Formula (I) for combinations (2×3=6 pairs) of each plane of the a phase and each plane of the γ phase. Then, an average value of the volume ratios Vγ of retained austenite of the six pairs was defined as the volume ratio (%) of retained austenite.

$$V\gamma=100/\{1+(I\alpha\times R\gamma)/(I\gamma\times R\alpha)\} \quad \text{(I)}$$

In Formula (I), Rα in the (200) plane of α phase was 15.9, Rα in the (211) plane of α phase was 29.2, and Rγ in the (200) plane of γ phase was 35.5, Rγ in the (220) plane of γ phase was 20.8, and Rγ in the (311) plane of γ phase was 21.8. Note that the volume ratio of retained austenite was obtained by rounding off the second decimal place of an obtained numerical value. Using the volume ratio (%) of retained austenite obtained by the X-ray diffraction method, the volume ratio (vol. %) of martensite of the microstructure of the steel material of each test number was obtained by the following Formula.

Volume ratio of martensite=100.0−volume ratio of retained austenite (%)

Obtained martensite volume ratios are shown in Table 3. As shown in Table 3, in any test number, the martensite volume ratio was 80.0% or more.

[Measurement Test of Prior γ Grain Diameter]

From a center portion of the thickness of the steel material of each test number, a test specimen was taken. The test specimen had an observation surface measuring 10 mm in the thickness direction and 10 mm in the width direction. That is, the observation surface was a cross section of the steel material that is perpendicular to the rolling direction of the steel material. The test specimen was embedded in resin, and the observation surface was mirror-polished. The observation surface was immersed in the Vilella's reagent (a mixed solution of ethanol, hydrochloric acid, and picric acid) for 60 seconds and then etched. Ten visual fields in the etched observation surface were observed under an optical microscope (with 200× magnification), and photographic images were created. Image processing was performed on the created photographic images to obtain the areas of prior-austenite grains, thereby obtaining circle equivalent diameters. The arithmetic mean value of the circle equivalent diameters of the prior-austenite grains obtained from the ten visual fields was determined as the prior γ grain diameter (μm). In this EXAMPLE, the prior γ grain diameter was 20 μm or less in any test number.

[Measurement Test of Depassivation pH]

From a center portion of the thickness of the steel material of each test number, a test specimen was taken. The test specimen was a disk-shaped test specimen having a size being a thickness of 1 mm and a diameter of 15 mm. On the disk-shaped test specimen, a resin coating was formed in a region other than the simulated surface. Note that conductors were connected in advance to a region of the disk-shaped test specimen other than the simulated surface. A plurality of specific test solutions that contained 5 mass % of NaCl (sodium chloride) and 0.41 g/L of $CH_3COONa$ (sodium acetate) and further contained $CH_3COOH$ (acetic acid) at concentrations different from one another were prepared. The pHs of the prepared specific test solutions were measured with a pH meter, and pHs of the specific test solutions were thereby determined. A plurality of specific test solutions having pHs substantially with a 0.2 pitch were prepared.

In each of the specific test solutions, the rest potential of each test specimen was measured by the following method. An electrolytic bath was prepared. As the electrolytic bath, a glass-made cell (800 mL) was used. Each specific test solution was poured into the electrolytic bath, and the electrolytic bath was deaerated for one hour or more with high purity Ar. Thereafter, a test gas (having an $H_2S$ partial pressure of 0.1 bar, with the balance being $CO_2$) was injected for 30 minutes or more, making the electrolytic bath saturated with the test gas. In the test, the specific test solution was held at a normal temperature (24±3C), and the electrolytic bath was brought into an air-tight state. Platinum was used as a counter electrode, and a saturated calomel electrode (SCE) was used as a reference electrode. Each test specimen was immediately immersed into the specific test solution, and the rest potential was measured using a potentiostat. During the test, the test gas was injected into the solution at a flow rate of about 10 mL/min to maintain the saturation.

After the elapse of four hours, at which the rest potential became stable sufficiently, the rest potential was measured. Test specimens corresponding to the specific test solutions having pHs substantially with a 0.2 pitch were prepared, and the rest potentials of the test specimens in the specific test solutions were determined. The relation between the determined rest potentials and pHs of the specific test solutions was plotted. Based on the plotted graph, as described above, the pH of the specific test solution immediately before the rest potential surges was defined as a "depassivation pH". The obtained depassivation pHs are shown in the "pHd" column in Table 3.

[Test Results]

Referring to Table 2 and Table 3, the chemical compositions of Test Nos. 1 to 13 were appropriate and their F1s satisfied Formula (1). Further, the production condition conditions were appropriate. For that reason, the martensite volume ratio of every one of Test Nos. 1 to 13 was 80.0% or more. Further, the depassivation pHs were 3.50 or less, and excellent general corrosion resistances were obtained.

On the other hand, in Test No. 14, the Ni contents of the chemical compositions was low, and F1 did not satisfy Formula (1). For that reason, the depassivation pH was more than 3.50, and general corrosion resistances was low.

In Test No. 15, the Cr contents of the chemical compositions was low, and F1 did not satisfy Formula (1). For that reason, the depassivation pH was more than 3.50, and general corrosion resistances was low.

In Test No. 16, the Mo content of the chemical composition was low, and F1 did not satisfy Formula (1). For that reason, the depassivation pH was more than 3.50, and general corrosion resistance was low.

In Test Nos. 17 to 18, although the chemical compositions were appropriate, and F1 did not satisfy Formula (1). For that reason, the depassivation pHs were more than 3.50, and general corrosion resistances were low.

In Test Nos. 19 to 21, although the chemical compositions were appropriate and F1 satisfied Formula (1), the pickling treatment was not performed. For that reason, the depassivation pHs were more than 3.50, and general corrosion resistances were low.

In Test Nos. 22 and 23, although the chemical compositions were appropriate and F1 satisfied Formula (1), the blasting treatment was not performed. For that reason, the depassivation pHs were more than 3.50, and general corrosion resistances were low.

In Test Nos. 24 and 25, although the chemical compositions were appropriate and F1 satisfied Formula (1), the blasting treatment and the pickling treatment were both not performed. For that reason, the depassivation pHs were more than 3.50, and general corrosion resistances were low.

So far, embodiments of the present invention have been described. However, those embodiments are merely exemplification for practicing the present invention. Therefore, the present invention will not be limited to the embodiments, and can be practiced by appropriately modifying the embodiments within a range not departing from the spirit thereof.

The invention claimed is:

1. A martensitic stainless seamless steel pipe comprising:

a chemical composition consisting of, in mass %,

C: 0.030% or less,

Si: 1.00% or less,

Mn: 1.00% or less,

P: 0.030% or less,

S: 0.0050% or less,

Al: 0.001 to 0.100%,

N: 0.0500% or less,

O: 0.050% or less,

Ni: 3.00 to 6.50%,

Cr: more than 10.00 to 13.40%,

Mo: 0.50 to 4.00%,

V: 0.01 to 1.00%,

Ti: 0.010 to 0.300%,

Co: 0.010 to 0.300%,

Ca: 0 to 0.0035%,

W: 0 to 1.50%, and with the balance being Fe and impurities, and satisfying Formula (1):

$$Cr+2.0Mo+0.5Ni+0.5Co \geq 16.0 \quad (1)$$

where, a content of a corresponding element, in mass %, is substituted for each symbol of an element in Formula (1), and a microstructure containing, in volume ratio, 80.0% or more of martensite, wherein an inner surface of the martensitic stainless seamless steel pipe has a depassivation pH of 3.50 or less in an aqueous solution that contains 5 mass % of NaCl, 0.41 g/L of $CH_3COONa$, and $CH_3COOH$.

2. The martensitic stainless seamless steel pipe according to claim 1, wherein the chemical composition contains:

Ca: 0.0010 to 0.0035%.

3. The martensitic stainless seamless steel pipe according to claim 1, wherein the chemical composition contains:

W: 0.10 to 1.50%.

4. The martensitic stainless seamless steel pipe according to claim 2, wherein the chemical composition contains:

W: 0.10 to 1.50%.

5. The martensitic stainless seamless steel pipe according to claim 1, wherein the martensitic stainless seamless steel pipe is a seamless steel pipe for oil wells.

6. The martensitic stainless seamless steel pipe according to claim 2, wherein the martensitic stainless seamless steel pipe is a seamless steel pipe for oil wells.

7. The martensitic stainless seamless steel pipe according to claim 3, wherein the martensitic stainless seamless steel pipe is a seamless steel pipe for oil wells.

8. The martensitic stainless seamless steel pipe according to claim 4, wherein the martensitic stainless seamless steel pipe is a seamless steel pipe for oil wells.

* * * * *